US007470389B2

(12) United States Patent
Berrigan et al.

(10) Patent No.: US 7,470,389 B2
(45) **Date of Patent: *Dec. 30, 2008**

(54) METHOD FOR FORMING SPREAD NONWOVEN WEBS

(75) Inventors: Michael R. Berrigan, Oakdale, MN (US); William T. Fay, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 485 days.

This patent is subject to a terminal disclaimer.

(21) Appl. No.: 10/934,194

(22) Filed: Sep. 3, 2004

(65) Prior Publication Data

US 2005/0140067 A1 Jun. 30, 2005

Related U.S. Application Data

(63) Continuation of application No. 10/151,781, filed on May 20, 2002, now abandoned, which is a continuation-in-part of application No. 09/835,904, filed on Apr. 16, 2001, now Pat. No. 6,607,624, which is a continuation-in-part of application No. 09/716,786, filed on Nov. 20, 2000, now abandoned.

(51) Int. Cl.
*D01D 5/092* (2006.01)
*D04H 3/02* (2006.01)

(52) U.S. Cl. ..... 264/555; 156/167; 156/181; 264/103; 264/211.14

(58) Field of Classification Search ..... 264/103, 264/211.14, 555; 156/167, 181
See application file for complete search history.

(56) References Cited

U.S. PATENT DOCUMENTS 3,502,763 A 3/1970 Hartmann (Continued)

FOREIGN PATENT DOCUMENTS

DE 40 14 414 7/1991

(Continued)

*Primary Examiner*—Leo B Tentoni
(74) *Attorney, Agent, or Firm*—Roger R. Tamte

(57) ABSTRACT

A new fiber-forming method, and related apparatus, and webs prepared by the new method and apparatus are taught. In the new method a) a stream of filaments is extruded from a die of known width and thickness; b) the stream of extruded filaments is directed through a processing chamber that is defined by two narrowly separated walls that are parallel to one another, parallel to said width of the die, and parallel to the longitudinal axis of the stream of extruded filaments; c) the stream of filaments passed through the processing chamber is intercepted on a collector where the filaments are collected as a nonwoven fibrous web; and d) a spacing between the walls of the processing chamber is selected that causes the stream of extruded filaments to spread before it reaches the collector and be collected as a web significantly wider in width than the die. Generally the increase in width is sufficient to be economically significant, e.g., to reduce costs of web manufacture. Such economic benefit can occur in widths that are 50, 100 or 200 or more millimeters greater in width than the width of the die. Preferably, the collected web has a width at least 50 percent greater than said width of the die. The processing chamber is preferably open to the ambient environment at its longitudinal sides to allow pressure within the processing chamber to push the stream of filaments outwardly toward the longitudinal sides of the chamber.

17 Claims, 7 Drawing Sheets

U.S. PATENT DOCUMENTS

| | | | | |
|---|---|---|---|---|
| 3,528,129 | A | 9/1970 | Hartmann | |
| 3,692,618 | A | 9/1972 | Dorschner et al. | |
| 3,734,803 | A | 5/1973 | Lipscomb et al. | |
| 3,766,606 | A | 10/1973 | Piper et al. | |
| 3,783,649 | A | 1/1974 | Yamamoto et al. | |
| 3,855,045 | A | 12/1974 | Brock | |
| 3,945,815 | A | 3/1976 | Schmidt | |
| 4,064,605 | A | 12/1977 | Akiyama et al. | |
| 4,086,381 | A | 4/1978 | Cheshire et al. | |
| 4,135,903 | A | 1/1979 | Ohsato et al. | |
| 4,147,749 | A | 4/1979 | Lipscomb et al. | |
| 4,163,819 | A | 8/1979 | Yung et al. | |
| 4,173,443 | A | 11/1979 | Lin | |
| 4,189,338 | A | 2/1980 | Ejima et al. | |
| 4,202,855 | A | 5/1980 | Gerking et al. | |
| 4,217,387 | A | 8/1980 | Viezee et al. | |
| 4,300,876 | A | 11/1981 | Kane et al. | |
| 4,340,563 | A | 7/1982 | Appel et al. | |
| 4,405,297 | A | 9/1983 | Appel et al. | |
| 4,622,259 | A | 11/1986 | McAmish et al. | |
| 4,627,811 | A | 12/1986 | Greiser et al. | |
| 4,692,106 | A | 9/1987 | Grabowski et al. | |
| 4,692,371 | A | 9/1987 | Morman et al. | |
| 4,812,112 | A | 3/1989 | Balk | |
| 4,818,466 | A | 4/1989 | Mente et al. | 264/555 |
| 4,820,459 | A | 4/1989 | Reifenhauser | |
| 4,838,774 | A | 6/1989 | Balk | |
| 4,908,163 | A | 3/1990 | McAmish et al. | |
| 4,961,695 | A | 10/1990 | Hirschmann et al. | |
| 4,988,560 | A | 1/1991 | Meyer et al. | |
| 5,045,271 | A | 9/1991 | Mente et al. | 264/555 |
| 5,244,723 | A | 9/1993 | Anderson et al. | |
| 5,270,107 | A | 12/1993 | Gessner | |
| 5,292,239 | A | 3/1994 | Zeldin et al. | |
| 5,296,286 | A | 3/1994 | Allen et al. | |
| 5,340,517 | A | 8/1994 | Koschinek et al. | |
| 5,405,559 | A | 4/1995 | Shambaugh | |
| 5,460,500 | A | 10/1995 | Geus et al. | |
| 5,476,616 | A | 12/1995 | Schwarz | |
| 5,525,286 | A | 6/1996 | Bornmann et al. | |
| 5,545,371 | A | 8/1996 | Lu | |
| 5,547,746 | A | 8/1996 | Burton, Sr. | |
| 5,571,537 | A | 11/1996 | Geus et al. | |
| 5,599,488 | A | 2/1997 | Profë | |
| 5,635,290 | A | 6/1997 | Stopper et al. | |
| 5,645,790 | A | 7/1997 | Schwarz et al. | |
| 5,648,041 | A | 7/1997 | Rodgers et al. | |
| 5,652,048 | A | 7/1997 | Haynes et al. | |
| 5,652,051 | A | 7/1997 | Shawver et al. | |
| 5,667,749 | A | 9/1997 | Lau et al. | |
| 5,688,468 | A | 11/1997 | Lu | |
| 5,711,970 | A | 1/1998 | Lau et al. | |
| 5,714,107 | A | 2/1998 | Levy et al. | |
| 5,714,171 | A | 2/1998 | Profë | |
| 5,762,857 | A | 6/1998 | Weng et al. | |
| 5,807,795 | A | 9/1998 | Lau et al. | |
| 5,814,349 | A | 9/1998 | Geus et al. | |
| 5,863,639 | A | 1/1999 | Franke et al. | |
| 5,885,909 | A | 3/1999 | Rudisill et al. | |
| 6,010,588 | A | 1/2000 | Stahl et al. | |
| 6,013,223 | A | 1/2000 | Schwarz | |
| 6,117,801 | A | 9/2000 | McGinty et al. | |
| 6,136,245 | A | 10/2000 | Lu | |
| 6,165,217 | A | 12/2000 | Hayes | |
| 6,183,684 | B1 | 2/2001 | Lu | |
| 6,274,238 | B1 | 8/2001 | DeLucia | |
| 6,379,136 | B1 | 4/2002 | Najour et al. | |
| 2002/0102897 | A1 | 8/2002 | Berrigan et al. | |
| 2003/0042651 | A1* | 3/2003 | Najour et al. | 264/211.14 |
| 2003/0118816 | A1* | 6/2003 | Polanco et al. | 428/369 |
| 2005/0098256 | A1* | 5/2005 | Polanco et al. | 156/167 |

FOREIGN PATENT DOCUMENTS

| | | |
|---|---|---|
| DE | 42 10 464 A1 | 10/1993 |
| EP | 0 538 480 | 4/1993 |
| RU | 487968 | 10/1975 |
| TW | 375664 | 12/1999 |
| WO | WO 00/28123 | 5/2000 |
| WO | WO 02/055782 | 7/2002 |

* cited by examiner

METHOD FOR FORMING SPREAD NONWOVEN WEBS

CROSS REFERENCE TO RELATED APPLICATIONS

This application is a continuation of application Ser. No. 10/151,781, filed May 20, 2002, now abandoned, which is a continuation-in-part of application Ser. No. 09/835,904, filed Apr. 16, 2001, now U.S. Pat. No. 6,607,624, which is a continuation-in-part of application Ser. No. 09/716,786, filed Nov. 20, 2000, now abandoned.

FIELD OF THE INVENTION

This invention relates to methods for preparing nonwoven webs from fibers extruded from an extrusion die.

BACKGROUND OF THE INVENTION

Fibrous nonwoven webs are conventionally prepared by extruding a liquid fiber-forming material through a die to form a stream of filaments, processing the filaments during their travel from the extrusion die (e.g., quenching and drawing them), and then intercepting the stream of filaments on a porous collector. The filaments deposit on the collector as a mass of fibers that either takes the form of a handleable web or may be processed to form such a web.

Typically, the collected mass or web is approximately the same width as the width of the die from which filaments were extruded: if a meter-wide web is to be prepared, the die is also generally on the order of a meter wide. Because wide webs are usually desired for the most economic manufacture, wide dies are also generally used.

But wide dies have some disadvantages. For example, dies are generally heated to help process the fiber-forming material through the die; and the wider the die, the more heat that is required. Also, wide dies are more costly to prepare than smaller ones, and can be more difficult to maintain. Also, the width of web to be collected may change depending on the intended use of the web; but accomplishing such changes by changing the width of the die or proportion of the die being utilized can be inconvenient.

SUMMARY OF THE INVENTION

The present invention provides a method for preparing fibrous nonwoven webs that have a controlled or selected width that is tailored to the intended use of the web and is significantly different from the width of the die from which filaments forming the web were extruded. In brief summary, a method of the invention comprises a) extruding a stream of filaments from a die having a known width and thickness; b) directing the stream of extruded filaments through a processing chamber that is defined by two narrowly separated walls that are parallel to one another, parallel to the width of the die, and parallel to the longitudinal axis of the stream of extruded filaments; c) collecting the processed filaments as a nonwoven fibrous web; and d) tailoring the width of the stream of filaments to a width different from the width of the die by adjusting the spacing between the walls to a selected amount that produces the tailored width. Most often, the desired tailored width of the stream of filaments is substantially greater than the width of the die, and the stream of filaments spreads as it travels from the die to the collector, where it is collected as a functional web. Generally, the width of the web upon collection is at least 50 or 100 millimeters or more greater than the width of the die; and preferably the width of the web is at least 200 millimeters or more greater than the width of the die. Narrower widths can also be obtained, thus adding further flexibility.

Preferably, the processing chamber is open to the ambient environment at its longitudinal sides over at least part of the length of the walls. Also, the walls preferably converge toward one another in the direction of filament travel to assist widening of the stream of extruded filaments.

DESCRIPTION OF THE PREFERRED EMBODIMENTS

Figure 1:
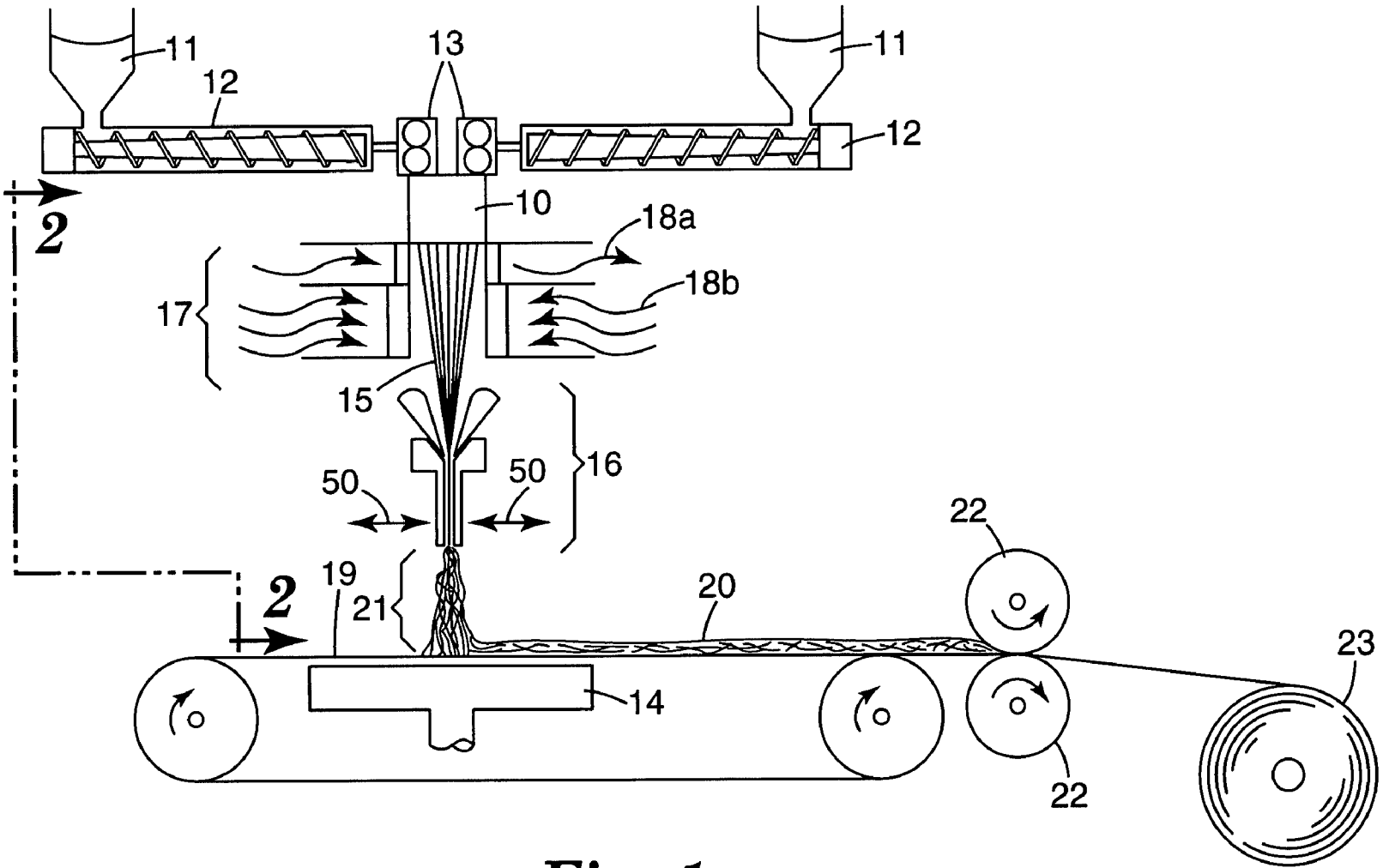
FIG. 1 is a schematic overall diagram of an apparatus useful in a method of the invention for forming a nonwoven fibrous web.

FIG. 1 shows an illustrative apparatus for carrying out the invention. Fiber-forming material is brought to an extrusion head or die 10—in this illustrative apparatus, by introducing a fiber-forming material into hoppers 11, melting the material in an extruder 12, and pumping the molten material into the extrusion head 10 through a pump 13. Although solid polymeric material in pellet or other particulate form is most commonly used and melted to a liquid, pumpable state, other fiber-forming liquids such as polymer solutions could also be used.

The extrusion head 10 may be a conventional spinnerette or spin pack, generally including multiple orifices arranged in a regular pattern, e.g., straightline rows. Filaments 15 of fiber-forming liquid are extruded from the extrusion head and conveyed to a processing chamber or attenuator 16. The distance 17 the extruded filaments 15 travel before reaching the attenuator 16 can vary, as can the conditions to which they are exposed. Typically, quenching streams of air or other gas 18 are presented to the extruded filaments by conventional methods and apparatus to reduce the temperature of the extruded filaments 15. Alternatively, the streams of air or other gas may be heated to facilitate drawing of the fibers. There may be one or more streams of air (or other fluid)—e.g., a first air stream 18*a* blown transversely to the filament stream, which may remove undesired gaseous materials or fumes released during extrusion; and a second quenching air stream 18*b* that achieves a major desired temperature reduction. Depending on the process being used or the form of finished product desired, the quenching air may be sufficient to solidify the extruded filaments 15 before they reach the attenuator 16. In other cases the extruded filaments are still in a softened or molten condition when they enter the attenuator. Alternatively, no quenching streams are used; in such a case ambient air or other fluid between the extrusion head 10 and the attenuator 16 may be a medium for any change in the extruded filaments before they enter the attenuator.

Figure 2:
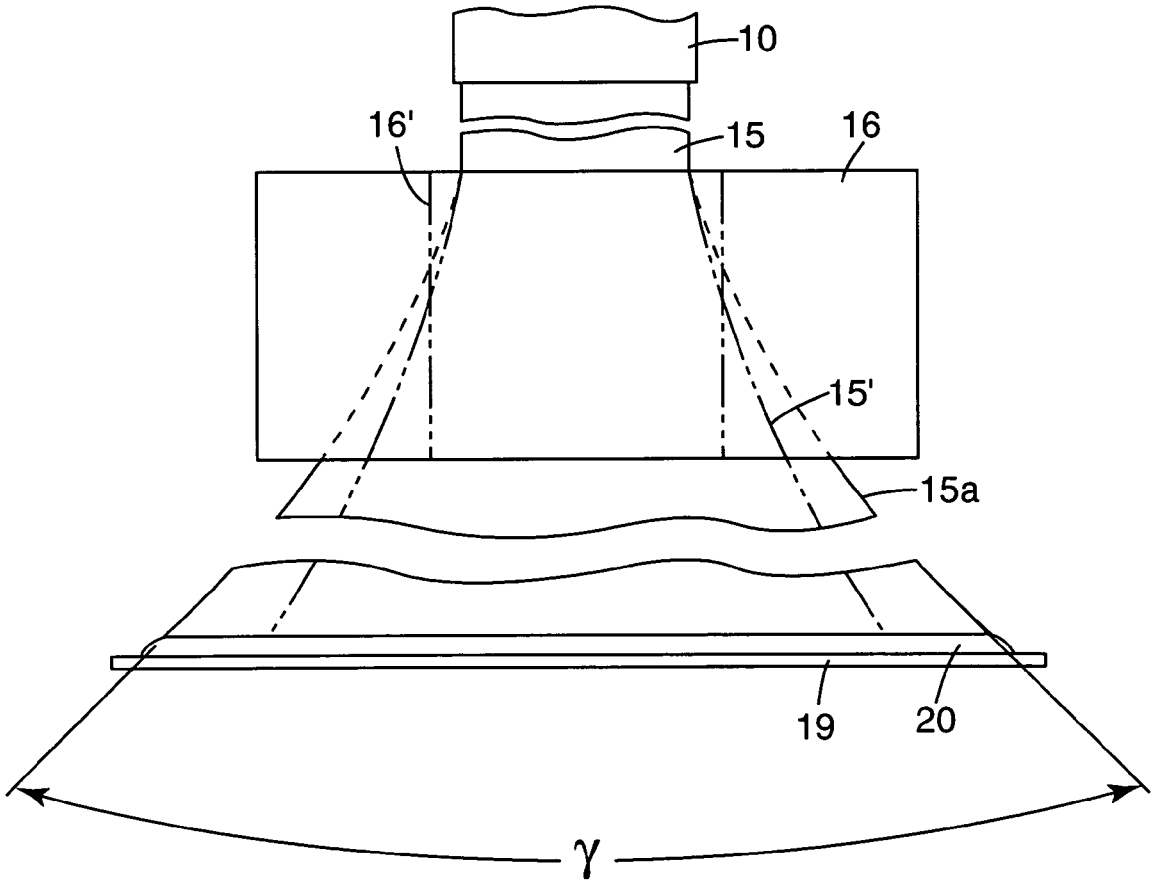
FIG. 2 is a schematic view of the apparatus of FIG. 1, viewed along the lines 2-2 in FIG. 1.

The stream of filaments 15 passes through the attenuator 16, as discussed in more detail below, and then exits. As illustrated in FIGS. 1 and 2, the stream exits onto a collector 19 where the filaments, or finished fibers, are collected as a mass of fibers 20 that may or may not be coherent and take the form of a handleable web. As discussed in more detail below and as illustrated in FIG. 2, the fiber or filament stream 15 preferably has spread when it exits from the attenuator and travels over the distance 21 to the collector 19. The collector 19 is generally porous and a gas-withdrawal device 14 can be positioned below the collector to assist deposition of fibers onto the collector. The collected mass 20 may be conveyed to other apparatus such as calenders, embossing stations, laminators, cutters and the like; or it may be passed through drive rolls 22 (FIG. 1) and wound into a storage roll 23. After passing through the processing chamber, but prior to collection, extruded filaments or fibers may be subjected to a number of additional processing steps not illustrated in FIG. 1, e.g., further drawing, spraying, etc.

Figure 3:
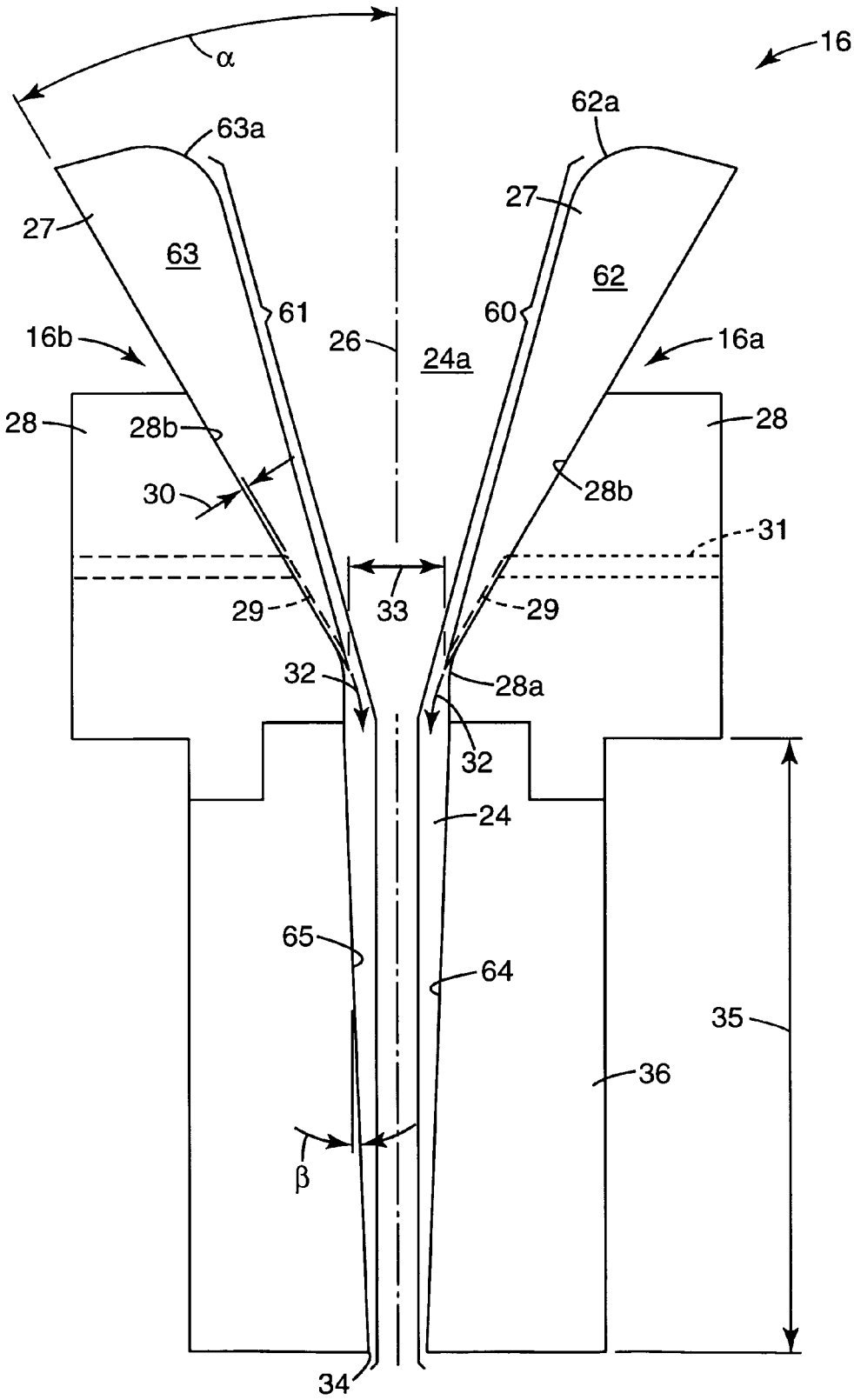
FIG. 3 is an enlarged side view of a processing chamber useful in the invention, with mounting means for the chamber not shown.

FIG. 3 is an enlarged side view of a representative, preferred processing device or attenuator 16 useful in practicing the invention. This representative and preferred device comprises two movable halves or sides 16*a* and 16*b* separated so as to define between them the processing chamber 24: the facing surfaces 60 and 61 of the sides 16*a* and 16*b* form the walls of the chamber. The illustrative device 16 allows a convenient adjustment of the distance between the parallel walls of the processing chamber to achieve a desired control over the width of the stream of extruded filaments according to the invention. The extent of spreading of the stream of extruded filaments or fibers can be controlled in this device by adjusting the distance between the walls 60 and 61 of the attenuator or processing device 16. This device is also preferred because it offers a desired continuity of operation even when running at high speeds with narrow-gap processing chambers and fiber-forming material in a softened condition when it enters the processing chamber. Such conditions tend to cause plugging and interruption of prior-art processing devices. Spreading of the stream of filaments according to the invention is aided by the ability to decrease the spacing between the walls of a processing chamber to narrow spacings, in at least some cases narrower than conventionally used with processing chambers in direct-web formation processes. The spacings used can create pressure within the chamber, causing the air flow to spread to a width as allowed by the configuration of the processing chamber and to carry extruded filaments throughout that width.

Figure 4:
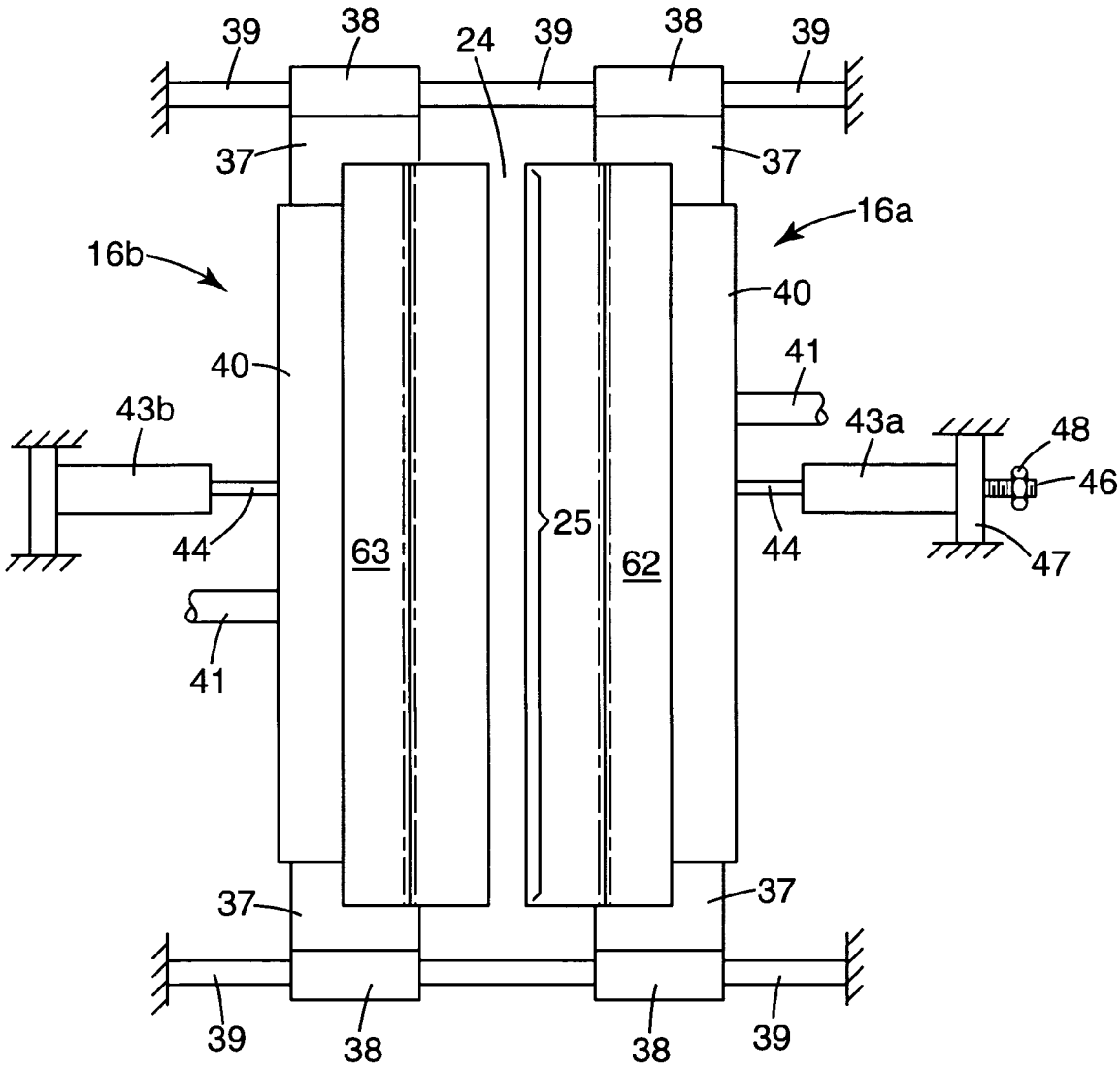
FIG. 4 is a top view, partially schematic, of the processing chamber shown in FIG. 3 together with mounting and other associated apparatus.

A means for adjusting the distance between the walls 60 and 61 for the preferred attenuator 16 is illustrated in FIG. 4, which is a top and somewhat schematic view at a different scale showing the attenuator and some of its mounting and support structure. As seen from the top view in FIG. 4, the processing or attenuation chamber 24 of the attenuator 16 is typically an elongated or rectangular slot, having a transverse length 25 (transverse to the longitudinal axis or path of travel of filaments through the attenuator and parallel to the width of the extrusion head or die 10).

Although existing as two halves or sides, the attenuator 16 functions as one unitary device and will be first discussed in its combined form. (The structure shown in FIGS. 3 and 4 is representative only, and a variety of different constructions may be used.). Slanted entry walls 62 and 63 define an entrance space or throat 24*a* into the attenuation chamber 24. The entry wall-sections 62 and 63 preferably are curved at the entry edge or surface 62*a* and 63*a* to smooth the entry of air streams carrying the extruded filaments 15. The wall-sections 62 and 63 are attached to a main body portion 28, and may be provided with a recessed area 29 to establish a gap 30 between the body portion 28 and wall-sections 62 and 63. Air or other gas may be introduced into the gaps 30 through conduits 31, creating air knives (i.e., pressurized gaseous streams represented by the arrows 32) that exert a pulling force on the filaments in the direction of filament travel and increase the velocity of the filaments, and that also have a further quenching effect on the filaments. The attenuator body 28 is preferably curved at 28*a* to smooth the passage of air from the air knife 32 into the passage 24. The angle ($\alpha$) of the surface 28*b* of the attenuator body can be selected to determine the desired angle at which the air knife impacts a stream of filaments passing through the attenuator. Instead of being near the entry to the chamber, the air knives may be disposed further within the chamber.

The attenuation chamber 24 may have a uniform gap width (the horizontal distance 33 on the page of FIG. 2 between the two attenuator sides or walls 60 and 61 is herein called the gap thickness) over its longitudinal length through the attenuator (the dimension along a longitudinal axis 26 through the attenuation chamber is called the axial length). Alternatively, as illustrated in FIG. 3, the gap thickness may vary along the length of the attenuator chamber. Preferably, the attenuation chamber narrows in thickness along its length toward the exit opening 34, e.g., at an angle $\beta$. Such a narrowing, or converging of the walls 60 and 61 at a point downstream from the air knives has been found to assist in at least some embodiments of the invention in causing the stream of extruded filaments to spread as it moves toward and through the exit of the attenuator and travels to the collector 19. In some embodiments of the invention the walls may slightly diverge over the axial length of the attenuation chamber at a point downstream from the air knives (in which case the stream of extruded filaments deposited on the collector may be narrower than the width of the extrusion head or die 10, which can be desirable for some products of the invention). Also, in some embodiments, the attenuation chamber is defined by straight or flat walls so that the spacing or gap width between the walls is constant over part or all the length of the walls. In all these cases, the walls 60 and 61 defining the attenuation or processing chamber are regarded herein as parallel to one another, because over at least a portion of their length the deviation from exact parallelism is relatively slight, and there is preferably substantially no deviation from parallelism in a direction transverse to the longitudinal length of the chamber (i.e., perpendicular to the page of FIG. 3). As illustrated in FIG. 3, the wall-sections 64 and 65 (of the walls 60 and 61, respectively) that define the main portion of the longitudinal length of the passage 24 may take the form of plates 36 that are separate from, and attached to, the main body portion 28.

Even if the walls defining the processing chamber converge over at least part of their length, they may also spread over a subsequent portion of their length, e.g., to create a suction or venturi effect. The length of the attenuation chamber 24 can be varied to achieve different effects; variation is especially useful with the portion between the air knives 32 and the exit opening 34, sometimes called herein the chute length 35. Longer chute lengths, chosen together with the spacing between the walls and any convergence or divergence of the walls, can increase spreading of the stream of filaments. Structure such as deflector surfaces, Coanda curved surfaces, and uneven wall lengths may be used at the exit to achieve a desired additional spreading or other distribution of fibers. In general, the gap width, chute length, attenuation chamber shape, etc. are chosen in conjunction with the material being processed and the mode of treatment desired to achieve other desired effects. For example, longer chute lengths may be useful to increase the crystallinity of prepared fibers. Conditions are chosen and can be widely varied to process the extruded filaments into a desired fiber form.

As illustrated in FIG. 4, the two sides 16*a* and 16*b* of the representative attenuator 16 are each supported through mounting blocks 37 attached to linear bearings 38 that slide on rods 39. The bearing 38 has a low-friction travel on the rod through means such as axially extending rows of ball-bearings disposed radially around the rod, whereby the sides 16*a* and 16*b* can readily move toward and away from one another. The mounting blocks 37 are attached to the attenuator body 28 and a housing 40 through which air from a supply pipe 41 is distributed to the conduits 31 and air knives 32.

In this illustrative embodiment, air cylinders 43*a* and 43*b* are connected, respectively, to the attenuator sides 16*a* and 16*b* through connecting rods 44 and apply a clamping force pressing the attenuator sides 16*a* and 16*b* toward one another. The clamping force is chosen in conjunction with the other operating parameters so as to balance the pressure existing within the attenuation chamber 24, and also, as discussed below, to set a desired spacing between the walls of the processing chamber. In other words, the clamping force and the force acting internally within the attenuation chamber to press the attenuator sides apart as a result of the gaseous pressure within the attenuator are in balance or equilibrium under preferred operating conditions. Filamentary material can be extruded, passed through the attenuator and collected as finished fibers while the attenuator parts remain in their established equilibrium or steady-state position and the attenuation chamber or passage 24 remains at its established equilibrium or steady-state gap width.

After startup and established operation of the representative apparatus illustrated in FIGS. 1-4 (i.e., to obtain a selected width of stream of filaments), movement of the attenuator sides or chamber walls generally occurs only if and when there is a perturbation of the system (sometimes the walls are intentionally moved during operation of the process to obtain a different width of stream). Such a perturbation may occur when a filament being processed breaks or tangles with another filament or fiber. Such breaks or tangles are often accompanied by an increase in pressure within the attenuation chamber 24, e.g., because the forward end of the filament coming from the extrusion head or the tangle is enlarged and creates a localized blockage of the chamber 24. The increased pressure can be sufficient to force the attenuator sides or chamber walls 16*a* and 16*b* to move away from one another. Upon this movement of the chamber walls the end of the incoming filament or the tangle can pass through the attenuator, whereupon the pressure in the attenuation chamber 24 returns to its steady-state value before the perturbation, and the clamping pressure exerted by the air cylinders 43 returns the attenuator sides to their steady-state position. Other perturbations causing an increase in pressure in the attenuation chamber include "drips," i.e., globular liquid pieces of fiber-forming material falling from the exit of the extrusion head upon interruption of an extruded filament, or accumulations of extruded filamentary material that may engage and stick to the walls of the attenuation chamber or to previously deposited fiber-forming material.

In effect, one or both of the sides 16*a* and 16*b* of the illustrative attenuator 16 "float," i.e., are not held in place by any structure but instead are mounted for a free and easy movement laterally in the direction of the arrows 50 in FIG. 1. In a preferred arrangement, the only forces acting on the attenuator sides other than friction and gravity are the biasing force applied by the air cylinders and the internal pressure developed within the attenuation chamber 24. Other clamping means than the air cylinder may be used, such as a spring(s), deformation of an elastic material, or cams; but the air cylinder offers a desired control and variability.

Many alternatives are available to cause or allow a desired movement of the processing chamber wall(s). For example, instead of relying on fluid pressure to force the wall(s) of the processing chamber apart, a sensor within the chamber (e.g., a laser or thermal sensor detecting buildup on the walls or plugging of the chamber) may be used to activate a servomechanical mechanism that separates the wall(s) and then returns them to their steady-state position. In another useful apparatus of the invention, one or both of the attenuator sides or chamber walls is driven in an oscillating pattern, e.g., by a servomechanical, vibratory or ultrasonic driving device. The rate of oscillation can vary within wide ranges, including, for example, at least rates of 5,000 cycles per minute to 60,000 cycles per second.

In still another variation, the movement means for both separating the walls and returning them to their steady-state position takes the form simply of a difference between the fluid pressure within the processing chamber and the ambient pressure acting on the exterior of the chamber walls. More specifically, during steady-state operation, the pressure within the processing chamber (a summation of the various forces acting within the processing chamber established, for example, by the internal shape of the processing chamber, the presence, location and design of air knives, the velocity of a fluid stream entering the chamber, etc.) is in balance with the ambient pressure acting on the outside of the chamber walls. If the pressure within the chamber increases because of a perturbation of the fiber-forming process, one or both of the chamber walls moves away from the other wall until the perturbation ends, whereupon pressure within the processing chamber is reduced to a level less than the steady-state pressure (because the gap thickness or spacing between the chamber walls is greater than at the steady-state operation). Thereupon, the ambient pressure acting on the outside of the chamber walls forces the chamber wall(s) back until the pressure within the chamber is in balance with the ambient pressure, and steady-state operation occurs. Lack of control over the apparatus and processing parameters can make sole reliance on pressure differences a less desired option.

In sum, besides being instantaneously movable and in some cases "floating," the wall(s) of the illustrative processing chamber are also generally subject to means for causing them to move in a desired way. The walls in this illustrative variety can be thought of as generally connected, e.g., physically or operationally, to means for causing a desired instantaneous movement of the walls. This movement means may be any feature of the processing chamber or associated apparatus, or an operating condition, or a combination thereof that causes the intended movement of the movable chamber walls—movement apart, e.g., to prevent or alleviate a perturbation in the fiber-forming process, and movement together, e.g., to establish or return the chamber to steady-state operation.

In the embodiment illustrated in FIGS. 1-3, the gap thickness 33 of the attenuation chamber 24 is interrelated with the pressure existing within the chamber, or with the fluid flow rate through the chamber and the fluid temperature. The clamping force matches the pressure within the attenuation chamber and varies depending on the gap thickness of the attenuation chamber: for a given fluid flow rate, the narrower the gap width, the higher the pressure within the attenuation chamber, and the higher must be the clamping force. Lower clamping forces allow a wider gap width. Mechanical stops, e.g., abutting structure on one or both of the attenuator sides 16*a* and 16*b* may be used to assure that minimum or maximum gap thicknesses are maintained.

In one useful arrangement, the air cylinder 43*a* applies a larger clamping force than the cylinder 43*b*, e.g., by use in cylinder 43*a* of a piston of larger diameter than used in cylinder 43*b*. This difference in force establishes the attenuator side 16*b* as the side that tends to move most readily when a perturbation occurs during operation. The difference in force is about equal to and compensates for the frictional forces resisting movement of the bearings 38 on the rods 39. Limiting means can be attached to the larger air cylinder 43*a* to limit movement of the attenuator side 16*a* toward the attenuator side 16*b*. One illustrative limiting means, as shown in FIG. 4, uses as the air cylinder 43*a* a double-rod air cylinder, in which the second rod 46 is threaded, extends through a mounting plate 47, and carries a nut 48 which may be adjusted to adjust the position of the air cylinder. Adjustment of the limiting means, e.g., by turning the nut 48, positions the attenuation chamber 24 into alignment with the extrusion head 10.

Because of the described instantaneous separation and reclosing of the attenuator sides 16*a* and 16*b*, the operating parameters for a fiber-forming operation are expanded. Some conditions that would previously make the process inoperable—e.g., because they would lead to filament breakage requiring shutdown for rethreading—become acceptable with a method and apparatus of this preferred embodiment; upon filament breakage, rethreading of the incoming filament end generally occurs automatically. For example, higher velocities that lead to frequent filament breakage may be used. Similarly, narrow gap thicknesses, which cause the air knives to be more focused and to impart more force and greater velocity on filaments passing through the attenuator, may be used. Or filaments may be introduced into the attenuation chamber in a more molten condition, thereby allowing greater control over fiber properties, because the danger of plugging the attenuation chamber is reduced. The attenuator may be moved closer to or further from the extrusion head to control among other things the temperature of the filaments when they enter the attenuation chamber.

Although the chamber walls of the attenuator 16 are shown as generally monolithic structures, they can also take the form of an assemblage of individual parts each mounted for the described instantaneous or floating movement. The individual parts comprising one wall engage one another through sealing means so as to maintain the internal pressure within the processing chamber 24. In a different arrangement, flexible sheets of a material such as rubber or plastic form the walls of the processing chamber 24, whereby the chamber can deform locally upon a localized increase in pressure (e.g., because of a plugging caused by breaking of a single filament or group of filaments). A series or grid of biasing means may engage the segmented or flexible wall; sufficient biasing means are used to respond to localized deformations and to bias a deformed portion of the wall back to its undeformed position. Alternatively, a series or grid of oscillating means may engage the flexible wall and oscillate local areas of the wall. Or, in the manner discussed above, a difference between the fluid pressure within the processing chamber and the ambient pressure acting on the wall or localized portion of the wall may be used to cause opening of a portion of the wall(s), e.g., during a process perturbation, and to return the wall(s) to the undeformed or steady-state position, e.g., when the perturbation ends. Fluid pressure may also be controlled to cause a continuing state of oscillation of a flexible or segmented wall.

The above description of the representative attenuator 16 shows that the walls 60 and 61 are movable to adjust the distance or select a spacing between them. Also, the walls are movable during operation of the illustrative apparatus to change the width of the collected web without stopping the operation. For example, increased pressure applied to the attenuator halves through the air cylinders 43*a* and/or 43*b* will cause the walls 60 and 61 to move closer together. Also, mechanical stops may be applied against the attenuator halves to cause the walls 60 and 61 to converge or diverge over the length of filament travel near the exit 34 of the processing chamber. In other, less convenient embodiments of the invention, the walls of the chamber are not moveable but instead may be fixed in the position that achieves a desired width of filament stream (e.g., the walls may be supported by apparatus that is not readily moved once a desired spacing, has been selected, so that the spacing is not changed either intentionally or instantaneously during operation of the device).

Figure 5:
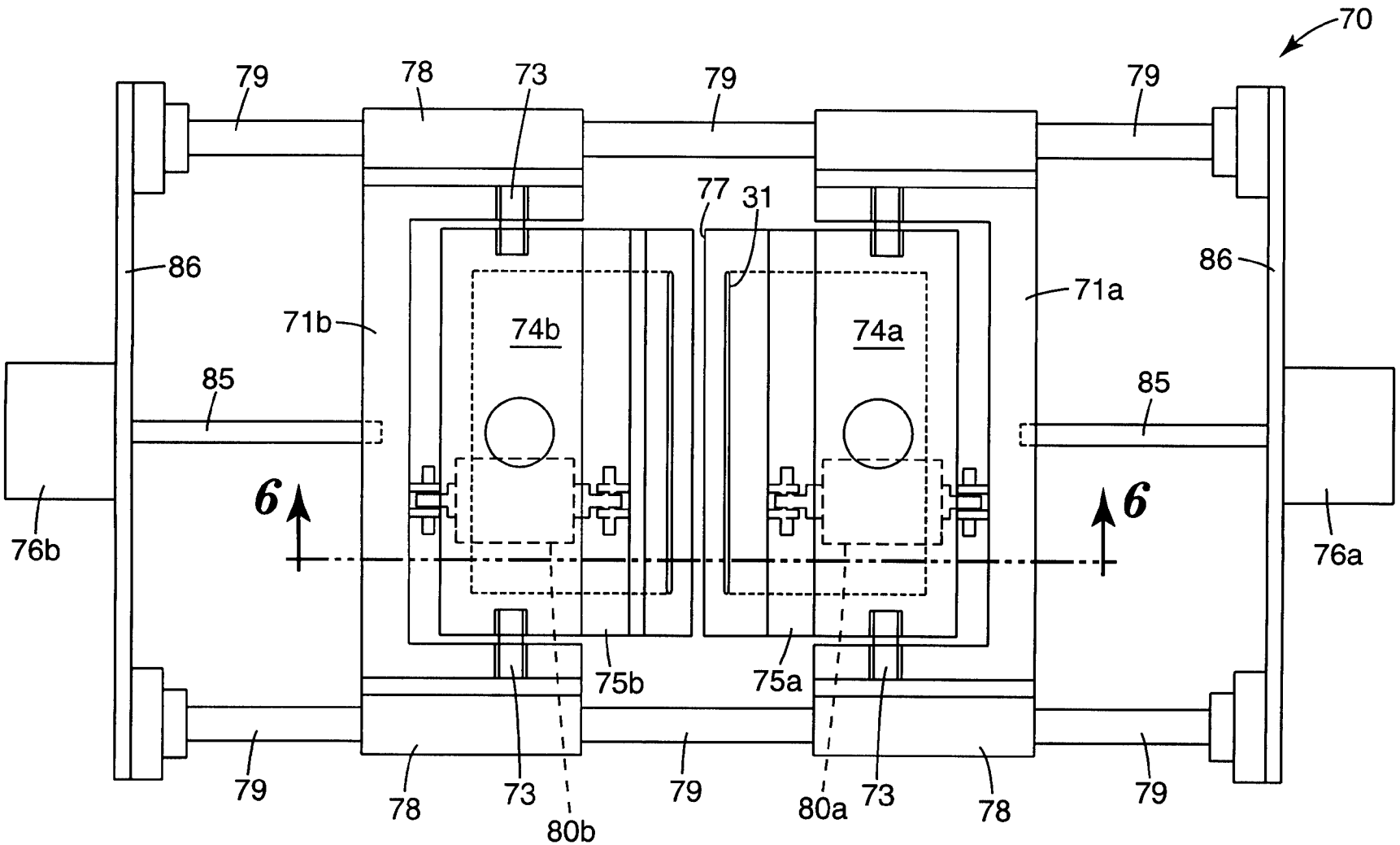
FIG. 5 is a top view of an alternative apparatus for practicing the invention.
Figure 6:
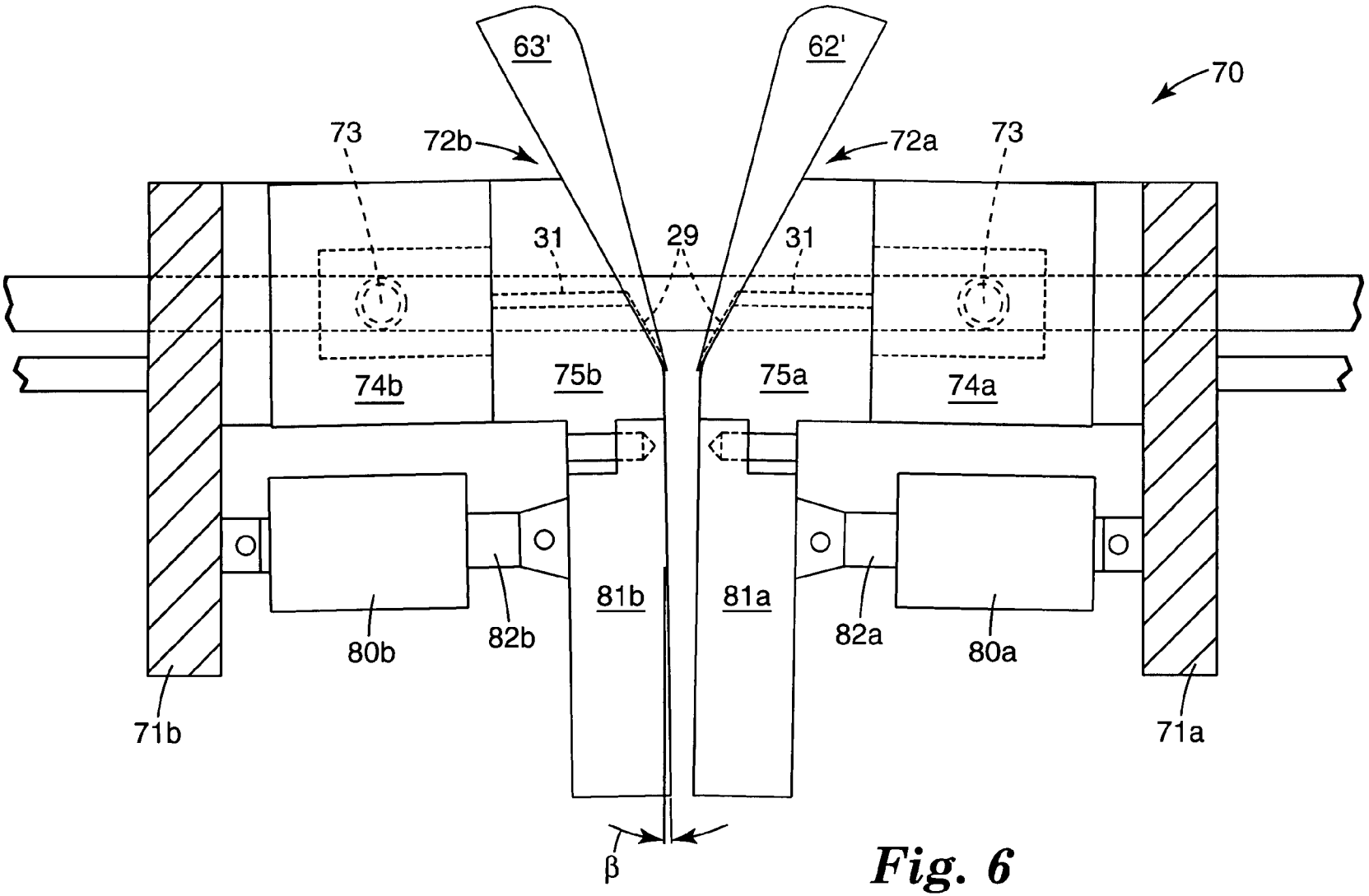
FIG. 6 is a sectional view taken along the lines 6-6 in FIG. 5.

FIGS. 5 and 6 show an illustrative processing device that facilitates movement of the walls defining the processing chamber, particularly a pivoting of the walls to change the angle β at which the walls converge or diverge as they near the exit of the device. The device 70 shown in FIGS. 5 and 6 includes mounting brackets 71*a* and 71*b*, which each pivotably support a device or attenuator half 72*a* and 72*b* on pins 73. The pins 73 rotatably extend into support blocks 74*a* and 74*b*, which are each affixed to a main body portion 75*a* and 75*b*, respectively, of a device half 72*a* and 72*b*. The mounting brackets 71*a* and 71*b* are each connected to an air cylinder 76*a* and 76*b*, respectively, through a rod 85 sliding in a support bracket 86. The air cylinders apply clamping pressure through the mounting brackets 71*a* and 71*b* onto the device halves 72*a* and 72*b* and thereby onto the processing chamber 77 defined between the attenuator halves. The mounting brackets 71*a* and 71*b* are attached to mounting blocks 78 which slide at low friction on rods 79.

Pivoting of a device or attenuator half is accomplished with adjustment mechanism pictured best in FIG. 6, taken on the lines 6-6 of FIG. 5 (with wall-sections 62' and 63' added). Each adjustment mechanism in the illustrated apparatus includes an actuator 80*a* or 80*b*, connected respectively between the bracket 71*a* or 71*b* and plates 81*a* or 81*b*, which correspond to the plates 36 in FIG. 2. One useful actuator comprises a threaded drive shaft 82*a* or 82*b* within the actuator that is driven by an electric motor to advance or retract the shaft. Movement of the shaft is conveyed through the plates 81*a* and 81*b* to pivot the device half about the pins 73.

As will be seen, in the preferred embodiments of processing chamber 24 and 77 illustrated in FIGS. 3-6, there are no side walls at the ends of the transverse length of the chamber. This means that the processing chamber is open to the ambient environment around the device. The result is that currents of air or gas in which the stream of filaments is entrained can spread out the sides of the chamber under the pressure existing within the chamber. Also, air or other gas can be drawn into the chamber. Similarly, fibers passing through the chamber can spread outwardly outside the chamber as they approach the exit of the chamber. Such a spreading can be desirable, as discussed above, to widen the mass of fibers collected on the collector.

In preferred embodiments substantially the whole stream of filaments travels within the processing chamber over the full length of the chamber (as represented by the lines 15*a* in FIG. 2), because that achieves a greater uniformity of properties between fibers in a collected web. For example, the fibers have a similar extent of attenuation and similar fiber size. The width of the processing device or attenuator (illustrated by 16 in FIG. 2 and pictured in solid lines) may be wider than the active width of the extrusion head or die 10 to accommodate travel of the filaments within the processing chamber. In other embodiments the fiber stream may spread outside a lesser-width processing chamber (as illustrated by the stream 15' shown in broken lines traveling through processing device 16' in FIG. 2). If the spreading is sufficient to cause an undesired variation in fiber properties, the collected mass of fibers may be trimmed so that only fibers that were substantially retained within the processing chamber during their travel to the collector are included within the finished fibrous nonwoven web. However, because travel through the processing chamber is generally only a minor portion of the travel of extruded filaments from the extrusion head to the collector (principal drawing of filaments and reduction in filament diameter often occurs before the filaments enter the processing chamber and after they leave the processing chamber), travel outside the sides of the processing chamber may not greatly affect the properties of the fibers.

The width of the collected web can be tailored to a desired width by control of the various parameters of the fiber-processing operation, including the spacing between the walls of the processing chamber. The finished web is a functional web (though various other steps such as bonding, spraying, etc. as discussed above may be needed for an intended use); that is, the collection of fibers is sufficient, generally with a degree of uniformity in properties across its width, for the web to function adequately for its intended use. Usually the basis weight of the web varies by not more than 30 percent across the width of the finished web, and preferably by not more than 10 percent. However, the web can be tailored to have special properties, including broader variation in properties, and including an intention to cut a collected web into segments of different properties.

For reasons of economics, the finished web is generally tailored to have a significantly wider width than the die from which filaments were extruded. The increase in width can be affected by parameters noted above, such as the spacing between the walls of the processing chamber, as well as other parameters such as the width of web being collected, the length of the attenuator, and the distance between the exit of the attenuator and the collector. Increases of 50 millimeters can be significant for some widths of web, but most often an increase of at least 100 millimeters is sought, and preferably an increase of 200 millimeters or more is obtained. The latter increase can offer significant commercial benefits to the widening process.

The included angle encompassed or occupied by the spread web 15 (the angle $\gamma$ in FIG. 2) depends on the targeted width of the web to be collected as well as parameters such as the distance from attenuator to collector. With common distances between attenuator and collector, the included angle $\gamma$ of the stream 15 is at least 10°, and more commonly is at least 15 or 20°. In many embodiments of the invention, the finished web (i.e., the collected web or trimmed portion of the collected web) is at least 50 percent wider than the width of the extrusion head or die (meaning the active width of the die, namely that portion through which fiber-forming liquid is extruded).

Figure 7:
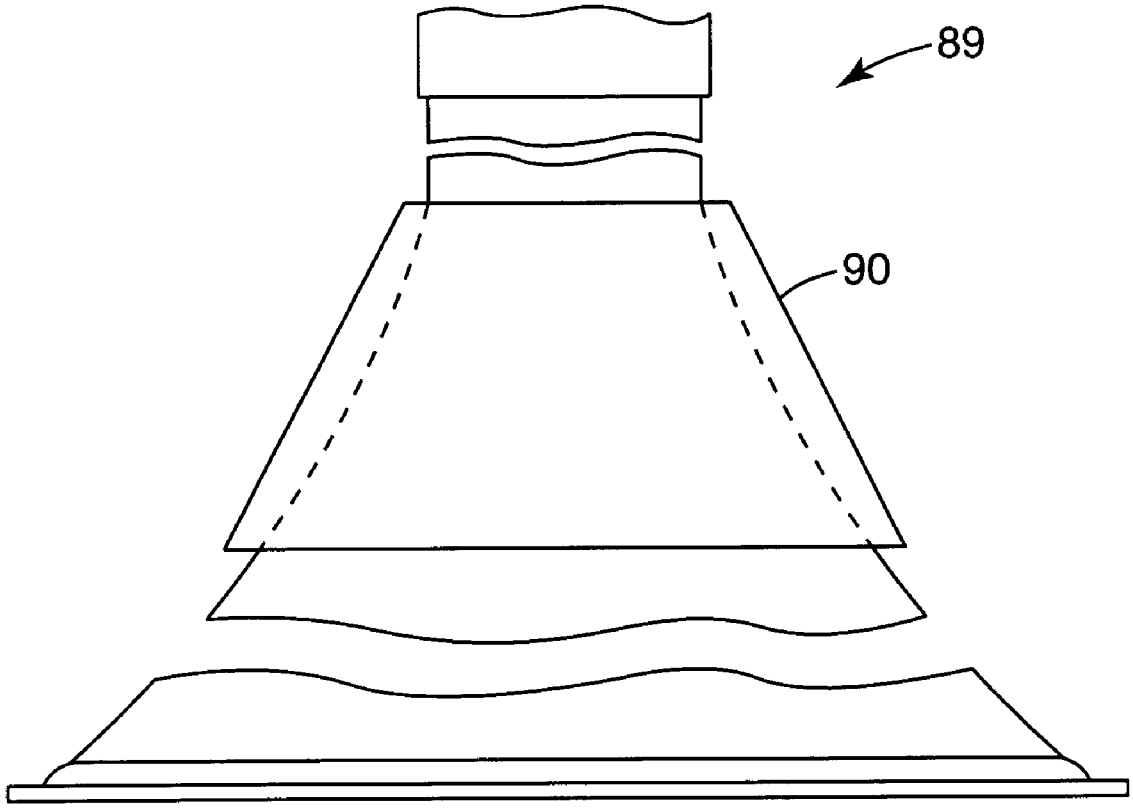
FIG. 7 is a schematic side view of part of an alternative apparatus useful in carrying out the invention.

FIG. 7 shows, from the same point of view as FIG. 2, an alternative apparatus 89 useful in the invention, which has a fan-shaped attenuator 90 that is advantageous in processing a spreading stream of filaments. The processing chamber, and the walls defining the processing chamber, spread or widen over the length of the processing chamber. Within the processing chamber the forces acting on the filaments is rather uniform over the whole width of the stream. The spacing of the walls is selected to cause the stream of filaments to spread in a desired amount.

Preferably the processing chamber 89, as in the case of the previously described chamber 16, has no sidewalls over most or all of the length of the parallel walls defining the processing chamber (as so as to allow the gaseous stream carrying the filaments to spread and to thus spread the stream of filaments) . However, the processing chamber of the apparatus 89 in FIG. 7, as well as the processing chamber in other embodiments, can include side walls; and spreading or narrowing of the stream of extruded filaments or fibers is still obtained by controlling the spacing between the walls that define the processing chamber. Sidewalls can have the advantage that they limit the intake of air from the sides that might affect the flow of filaments. In these embodiments a single sidewall at one transverse end of the chamber is generally not attached to both chamber halves or sides, because attachment to both chamber sides would prevent movement together or apart of devices halves, including the instantaneous separation of the sides as discussed above. Instead, a sidewall(s) may be attached to one chamber side and move with that side when and if it moves during adjustment of the adjustment mechanism or in response to instantaneous movement means as discussed above. In other embodiments, the side walls are divided, with one portion attached to one chamber side, and the other portion attached to the other chamber side, with the sidewall portions preferably overlapping if it is desired to confine the stream of processed fibers within the processing chamber.

While spreading of the collected stream of filaments is generally preferred, formation of webs narrower than the die (e.g., 75% or 50% of the width of the die or narrower) may be useful. Such narrowing can be obtained by controlling the spacing between the walls of the processing chamber; also, diverging of the walls in the direction of filament travel has been found to be potentially helpful in achieving such a narrowing.

A wide variety of fiber-forming materials may be used to make fibers with a method and apparatus of the invention. Either organic polymeric materials, or inorganic materials, such as glass or ceramic materials, may be used. While the invention is particularly useful with fiber-forming materials in molten form, other fiber-forming liquids such as solutions or suspensions may also be used. Any fiber-forming organic polymeric materials may be used, including the polymers commonly used in fiber formation such as polyethylene, polypropylene, polyethylene terephthalate, nylon, and urethanes. Some polymers or materials that are more difficult to form into fibers by spunbond or meltblown techniques can be used, including amorphous polymers such as cyclic olefins (which have a high melt viscosity that limits their utility in conventional direct-extrusion techniques), block copolymers, styrene-based polymers, and adhesives (including pressure-sensitive varieties and hot-melt varieties). The specific polymers listed here are examples only, and a wide variety of other polymeric or fiber-forming materials are useful. Interestingly, fiber-forming processes of the invention using molten polymers can often be performed at lower temperatures than traditional direct extrusion techniques, which offers a number of advantages.

Fibers also may be formed from blends of materials, including materials into which certain additives have been blended, such as pigments or dyes. Bicomponent fibers, such as core-sheath or side-by-side bicomponent fibers, may be prepared ("bicomponent" herein includes fibers with two or more than two components). In addition, different fiber-forming materials may be extruded through different orifices of the extrusion head so as to prepare webs that comprise a mixture of fibers. In other embodiments of the invention other materials are introduced into a stream of fibers prepared according to the invention before or as the fibers are collected so as to prepare a blended web. For example, other staple fibers may be blended in the manner taught in U.S. Pat. No. 4,118,531; or particulate material may be introduced and captured within the web in the manner taught in U.S. Pat. No. 3,971,373; or microwebs as taught in U.S. Pat. No. 4,813,948 may be blended into the webs. Alternatively, fibers prepared by the present invention may be introduced into a stream of other fibers to prepare a blend of fibers.

A fiber-forming process of the invention can be controlled to achieve different effects and different forms of web. The invention is particularly useful as a direct-web-formation process in which a fiber-forming polymeric material is converted into a web in one essentially direct operation, such as is done in spunbond or meltblown processes. Often the invention is used to obtain a mat of fibers of at least a minimum thickness (e.g., 5 mm or more) and loft (e.g., 10 cc/gram or more); thinner webs can be prepared, but webs of some thickness offer some advantages for uses such as insulation, filtration, cushioning, or sorbency. Webs in which the collected fibers are autogenously bondable (bondable without aid of added binder material or embossing pressure) are especially useful.

As further examples of process control, a process of the invention can be controlled to control the temperature and solidity (i.e., moltenness) of filaments entering the processing chamber (e.g., by moving the processing chamber closer to or further from the extrusion head, or increasing or decreasing the volume or the temperature of quenching fluids). In some cases at least a majority of the extruded filaments of fiber-forming material solidify before entering the processing chamber. Such solidification changes the nature of the action of the air impacting the filaments in the processing chamber and the effects within the filaments, and changes the nature of the collected web. In other processes of the invention the process is controlled so that at least a majority of the filaments solidify after they enter the processing chamber, whereupon they may solidify within the chamber or after they exit the chamber. Sometimes the process is controlled so that at least a majority of the filaments or fibers solidify after they are collected, so the fibers are sufficiently molten that when collected they may become adhered at points of fiber intersection.

A wide variety of web properties may be obtained by varying the process. For example, when the fiber-forming material has essentially solidified before it reaches the attenuator, the web will be more lofty and exhibit less or no interfiber bonding. By contrast, when the fiber-forming material is still molten at the time it enters the attenuator, the fibers may still be soft when collected so as to achieve interfiber bonding.

Use of a processing device as illustrated in FIGS. 1-7 can have the advantage that filaments may be processed at very fast velocities. Velocities can be achieved that are not known to be previously available in direct-web-formation processes that use a processing chamber in the same role as the typical role of a processing chamber of the present invention, i.e., to provide primary attenuation of extruded filamentary material. For example, polypropylene is not known to have been processed at apparent filament speeds of 8000 meters per minute in processes that use such a processing chamber, but such apparent filament speeds are possible with the present invention (the term apparent filament speed is used, because the speeds are calculated, e.g., from polymer flow rate, polymer density, and average fiber diameter). Even faster apparent filament speeds have been achieved, e.g., 10,000 meters per minute, or even 14,000 or 18,000 meters per minute, and these speeds can be obtained with a wide range of polymers. In addition, large volumes of polymer can be processed per orifice in the extrusion head, and these large volumes can be processed while at the same time moving extruded filaments at high velocity. This combination gives rise to a high productivity index—the rate of polymer throughput (e.g., in grams per orifice per minute) multiplied by the apparent velocity of extruded filaments (e.g., in meters per minute). The process of the invention can be readily practiced with a productivity index of 9000 or higher, even while producing filaments that average 20 micrometers or less in diameter.

Various processes conventionally used as adjuncts to fiber-forming processes may be used in connection with filaments as they enter or exit from the attenuator, such as spraying of finishes or other materials onto the filaments, application of an electrostatic charge to the filaments, application of water mists, etc. In addition, various materials may be added to a collected web, including bonding agents, adhesives, finishes, and other webs or films.

Although there typically is no reason to do so, filaments may be blown from the extrusion head by a primary gaseous stream in the manner of that used in conventional meltblowing operations. Such primary gaseous streams cause an initial attenuation and drawing of the filaments.

The fibers prepared by a method of the invention may range widely in diameter. Microfiber sizes (about 10 micrometers or less in diameter) may be obtained and offer several benefits; but fibers of larger diameter can also be prepared and are useful for certain applications; often the fibers are 20 micrometers or less in diameter. Fibers of circular cross-section are most often prepared, but other cross-sectional shapes may also be used. Depending on the operating parameters chosen, e.g., degree of solidification from the molten state before entering the attenuator, the collected fibers may be rather continuous or essentially discontinuous. The orientation of the polymer chains in the fibers can be influenced by selection of operating parameters, such as degree of solidification of filament entering the attenuator, velocity and temperature of air stream introduced into the attenuator by the air knives, and axial length, gap width and shape (because, for example, shape can influence a venturi effect) of the attenuator passage.

Unique fibers and fiber properties, and unique fibrous webs, have been achieved on processing devices as pictured in FIGS. 1-7. For example, in some collected webs, fibers are found that are interrupted, i.e., are broken, or entangled with themselves or other fibers, or otherwise deformed as by engaging a wall of the processing chamber. The fiber segments at the location of the interruption—i.e., the fiber segments at the point of a fiber break, and the fiber segments in which an entanglement or deformation occurs—are all termed an interrupting fiber segment herein, or more commonly for shorthand purposes, are often simply termed "fiber ends": these interrupting fiber segments form the terminus or end of an unaffected length of fiber, even though in the case of entanglements or deformations there often is no actual break or severing of the fiber. The fiber ends have a fiber form (as opposed to a globular shape as sometimes obtained in meltblowing or other previous methods) but are usually enlarged in diameter over the intermediate portions of the fiber; usually they are less than 300 micrometers in diameter. Often, the fiber ends, especially broken ends, have a curly or spiral shape, which causes the ends to entangle with themselves or other fibers. And the fiber ends may be bonded side-by-side with other fibers, e.g., by autogenous coalescing of material of the fiber end with material of an adjacent fiber.

Fiber ends as described arise because of the unique character of the fiber-forming process of FIGS. 1-7, which can continue in spite of breaks and interruptions in individual fiber formation. Such fiber ends may not occur in all collected webs of the invention (for example, they may not occur if the extruded filaments of fiber-forming material have reached a high degree of solidification before they enter the processing chamber). Individual fibers may be subject to an interruption, e.g., may break while being drawn in the processing chamber, or may entangle with themselves or another fiber as a result of being deflected from the wall of the processing chamber or as a result of turbulence within the processing chamber, perhaps while still molten; but notwithstanding such interruption, the fiber-forming process continues. The result is that the collected web includes a significant and detectable number of the fiber ends, or interrupting fiber segments where there is a discontinuity in the fiber. Since the interruption typically occurs in or after the processing chamber, where the fibers are typically subjected to drawing forces, the fibers are under tension when they break, entangle or deform. The break, or entanglement generally results in an interruption or release of tension allowing the fiber ends to retract and gain in diameter. Also, broken ends are free to move within the fluid currents in the processing chamber, which at least in some cases leads to winding of the ends into a spiral shape and entangling with other fibers.

Analytical study and comparisons of the fiber ends and middle portions typically reveals a different morphology between the ends and middles. The polymer chains in the fiber ends usually are oriented, but not to the degree they are oriented in the middle portions of the fibers. This difference in orientation can result in a difference in the proportion of crystallinity and in the kind of crystalline or other morphological structure. And these differences are reflected in different properties.

In general, when fiber middles and ends prepared by this invention are evaluated using a properly calibrated differential scanning calorimeter (DSC), the fiber middles and ends will differ from each other as to one or more of the common thermal transitions by at least the resolution of the testing instrument (0.1° C.), due to the differences in the mechanisms operating internally within the fiber middles and fiber ends. For example, when experimentally observable, the thermal transitions can differ as follows: 1) the glass transition temperature, $T_g$, for middles can be slightly higher in temperature than for ends, and the feature can diminish in height as crystalline content or orientation in the fiber middle increases; 2) when observed, the onset temperature of cold crystallization, $T_c$, and the peak area measured during cold crystallization will be lower for the fiber middle portion relative to the fiber ends, and finally, 3) the melting peak temperature, $T_m$, for the fiber middles will either be elevated over the $T_m$ observed for the ends, or become complex in nature showing multiple endothermic minima (i.e., multiple melting peaks representing different melting points for different molecular portions that, for example, differ in the order of their crystalline structure), with one molecular portion of the middle portion of the fiber melting at a higher temperature than molecular portions of the fiber ends. Most often, fiber ends and fiber middles differ in one or more of the parameters glass transition temperature, cold crystallization temperature, and melting point by at least 0.5 or 1 degree C.

Webs including fibers with enlarged fibrous ends have the advantage that the fiber ends may comprise a more easily softened material adapted to increase bonding of a web; and the spiral shape can increase coherency of the web.

EXAMPLES

Apparatus as shown in FIG. 1 was used to prepare fibrous webs from a number of different polymers as summarized in Table 1. Specific parts of the apparatus and operating conditions were varied as described below and as also summarized in Table 1. The extrusion die used in all the examples had an active width of four inches (about 10 centimeters). Table 1 also includes a description of characteristics of the fibers prepared, including the width of the nonwoven web collected.

Examples 1-22 and 42-43 were prepared from polypropylene; Examples 1-13 were prepared from a polypropylene having a melt flow index (MFI) of 400 (Exxon 3505G), Example 14 was prepared from polypropylene having a MFI of 30 (Fina 3868), Examples 15-22 were prepared from a polypropylene having a MFI of 70 (Fina 3860), and Examples 42-43 were prepared from a polypropylene having a MFI of 400 (Fina 3960). Polypropylene has a density of 0.91 g/cc.

Examples 23-32 and 44-46 were prepared from polyethylene terephthalate; Examples 23-26, 29-32 and 44 were prepared from PET having an intrinsic viscosity (IV) of 0.61 (3M 651000), Example 27 was prepared from PET having an IV of 0.36, Example 28 was prepared from PET having an IV of 0.9 (a high-molecular-weight PET useful as a high-tenacity spinning fiber supplied as Crystar 0400 supplied by Dupont Polymers), and Examples 45 and 46 were prepared from PETG (AA45-004 made by Paxon Polymer Company, Baton Rouge, La.). PET has a density of 1.35 and PETG has a density of about 1.30.

Examples 33 and 41 were prepared from a nylon 6 polymer (Ultramid PA6 B-3 from BASF) having an MFI of 130 and a density of 1.15. Example 34 was prepared from polystyrene (Crystal PS 3510 supplied by Nova Chemicals) and having an MFI of 15.5 and density of 1.04. Example 35 was prepared from polyurethane (Morton PS-440-200) having a MFI of 37 and density of 1.2. Example 36 was prepared from polyethylene (Dow 6806) having a MFI of 30 and density of 0.95. Example 37 was prepared from a block copolymer comprising 13 percent styrene and 87 percent ethylene butylene copolymer (Shell Kraton G1657) having a MFI of 8 and density of 0.9.

Example 38 was a bicomponent core-sheath fiber having a core (89 weight percent) of the polystyrene used in Example 34 and a sheath (11 weight percent) of the copolymer used in Example 37. Example 39 was a bicomponent side-by-side fiber prepared from polyethylene (Exxact 4023 supplied by Exxon Chemicals having a MFI of 30); 36 weight percent) and a pressure-sensitive adhesive 64 weight percent). The adhesive comprised a terpolymer of 92 weight percent isooctylacrylate, 4 weight percent styrene, and 4 weight percent acrylic acid, had an intrinsic viscosity of 0.63, and was supplied through a Bonnot adhesive extruder.

In Example 40 each fiber was single-component, but fibers of two different polymer compositions were used—the polyethylene used in Example 36 and the polypropylene used in Examples 1-13. The extrusion head had four rows of orifices, with 42 orifices in each row; and the supply to the extrusion head was arranged to supply a different one of the two polymers to adjacent orifices in a row to achieve an A-B-A . . . pattern.

In Example 47 a fibrous web was prepared solely from the pressure-sensitive adhesive that was used as one component of bicomponent fibers in Example 39; a Bonnot adhesive extruder was used.

In Examples 42 and 43 the air cylinders used to bias the movable sides or walls of the attenuator were replaced with coil springs. In Example 42, the springs deflected 9.4 millimeters on each side during operation in the example. The spring constant for the spring was 4.38 Newtons/millimeter so the clamping force applied by each spring was 41.1 Newtons. In Example 43, the spring deflected 2.95 millimeters on each side, the spring constant was 4.9 Newtons/millimeter, and the clamping force was 14.4 Newtons.

In Example 44 the extrusion head was a meltblowing die, which had 0.38-millimeter-diameter orifices spaced 1.02 millimeters center to center. The row of orifices was 101.6 millimeters long. Primary meltblowing air at a temperature of 370 degrees C. was introduced through a 203-millimeter-wide air knife on each side of the row of orifices at a rate of 0.45 cubic meters per minute (CMM) for the two air knives in combination.

In Example 47 pneumatic rotary ball vibrators oscillating at about 200 cycles per second were connected to each of the movable attenuator sides or walls; the air cylinders remained in place and aligned the attenuator chamber under the extrusion head and were available to return the attenuator sides to their original position in the event a pressure buildup forced the sides apart. During operation of the example, a lesser quantity of pressure-sensitive adhesive stuck onto the attenuator walls when the vibrators were operating than when they were not operating. In Examples 7 and 37 the clamping force was zero, but the balance between air pressure within the processing chamber and ambient pressure established the gap between chamber walls and returned the moveable side walls to their original position after any perturbations.

In each of the examples the polymer formed into fibers was heated to a temperature listed in Table 1 (temperature measured in the extruder 12 near the exit to the pump 13), at which the polymer was molten, and the molten polymer was supplied to the extrusion orifices at a rate as listed in the table. The extrusion head generally had four rows of orifices, but the number of orifices in a row, the diameter of the orifices, and the length-to-diameter ratio of the orifices were varied as listed in the table. In Examples 1-2, 5-7, 14-24, 27, 29-32, 34, and 36-40 each row had 42 orifices, making a total of 168 orifices. In the other examples with the exception of Example 44, each row had 21 orifices, making a total of 84 orifices.

The attenuator parameters were also varied as described in the table, including the air knife gap (the dimension 30 in FIG. 3); the attenuator body angle ($\alpha$ in FIG. 3); the temperature of the air passed through the attenuator; quench air rate; the clamping pressure and force applied to the attenuator by the air cylinders; the total volume of air passed through the attenuator (given in actual cubic meters per minute, or ACMM; about half of the listed volume was passed through each air knife 32); the gaps at the top and bottom of the attenuator (the dimensions 33 and 34, respectively, in FIG. 3); the length of the attenuator chute (dimension 35 in FIG. 3); the distance from the exit edge of the die to the attenuator (dimension 17 in FIG. 1); and the distance from the attenuator exit to the collector (dimension 21 in FIG. 1). The air knife had a transverse length (the direction of the length 25 of the slot in FIG. 4) of about 120 millimeters; and the attenuator body 28 in which the recess for the air knife was formed had a transverse length of about 152 millimeters. The transverse length of the wall 36 attached to the attenuator body was varied: in Examples 1-5, 8-25, 27-28, 33-35, and 37-47, the transverse length of the wall was 254 millimeters; in Example 6, 26, 29-32 and 36 it was about 406 millimeters; and in Example 7 it was about 127 millimeters.

Properties of the collected fibers are reported including the average fiber diameter, measured from digital images acquired from a scanning electron microscope and using an image analysis program UTHSCSA IMAGE Tool for Windows, version 1.28, from the University of Texas Health Science Center in San Antonio (copyright 1995-97). The images were used at magnifications of 500 to 1000 times, depending on the size of the fibers.

The apparent filament speed of the collected fibers was calculated from the equation, $$V_{apparent}=4M/\rho\pi d_f^2, \text{ where}$$

M is the polymer flow rate per orifice in grams/cubic meter, $\rho$ is the polymer density, and $d_f$ is the measured average fiber diameter in meters.

The tenacity and elongation to break of the fibers were measured by separating out a single fiber under magnification and mounting the fiber in a paper frame. The fiber was tested for breaking strength by the method outlined in ASTM D3822-90. Eight different fibers were used to determine an average breaking strength and an average elongation to break. Tenacity was calculated from the average breaking strength and the average denier of the fiber calculated from the fiber diameter and polymer density.

Samples were cut from the prepared webs, including portions comprising a fiber end, i.e., a fiber segment in which an interruption taking the form of either a break or an entanglement had occurred, and portions comprising the fiber middle, i.e., the main unaffected portion of the fibers, and the samples were submitted for analysis by differential scanning calorimetry, specifically Modulated DSC™ using a Model 2920 device supplied by TA Instruments Inc, New Castle, Del., and using a heating rate of 4 degrees C./minute, a perturbation amplitude of plus-or-minus 0.636 degrees C., and a period of 60 seconds. Melting points for both the fiber ends and the middles were determined; the maximum melting point peak on the DSC plots for the fiber middles and ends are reported in Table 1.

Although in some cases no difference between middles and ends was detected as to melting point, other differences were often seen even in those examples, such as differences in glass transition temperature.

The samples of fiber middles and ends were also submitted for X-ray diffraction analysis. Data were collected by use of a Bruker microdiffractometer (supplied by Bruker AXS, Inc. Madison, Wis.), copper $K_\alpha$ radiation, and HI-STAR 2D position sensitive detector registry of the scattered radiation. The diffractometer was fitted with a 300-micrometer collimator and graphite-incident-beam monochromator. The X-ray generator consisted of a rotating anode surface operated at settings of 50 kV and 100 mA and using a copper target. Data were collected using a transmission geometry for 60 minutes with the detector centered at 0 degrees ($2\theta$). Samples were corrected for detector sensitivity and spatial irregularities using the Bruker GADDS data analysis software. The corrected data were averaged azimuthally, reduced to x-y pairs of scattering angle ($2\theta$) and intensity values, and subjected to profile fitting by using the data analysis software ORIGIN™ (supplied by Microcal Software, Inc. Northhampton, Mass.) for evaluation of crystallinity.

A gaussian peak shape model was employed to describe the individual crystalline peak and amorphous peak contributions. For some data sets, a single amorphous peak did not adequately account for the total amorphous scattered intensity. In these cases additional broad maxima were employed to fully account for the observed amorphous scattered intensity. Crystallinity indices were calculated as the ratio of crystalline peak area to total scattered peak area (crystalline plus amorphous) within the 6-to-36 degree (2θ) scattering angle range. A value of unity represents 100 percent crystallinity and a value of zero corresponds to a completely amorphous material. Values obtained are reported in Table 1.

As to five examples of webs made from polypropylene, Examples 1, 3, 13, 20 and 22, X-ray analysis revealed a difference between middles and ends in that the ends included a beta crystalline form, measured at 5.5 angstroms.

Draw area ratios were determined by dividing the cross-sectional area of the die orifice by the cross-sectional area of the completed fibers, calculated from the average fiber diameter. Productivity index was also calculated.

TABLE 1

| | | Example Number | | | | | | | | | |
|---|---|---|---|---|---|---|---|---|---|---|---|
| | | 1 | 2 | 3 | 4 | 5 | 6 | 7 | 8 | 9 | 10 |
| Polymer | | PP | PP | PP | PP | PP | PP | PP | PP | PP | PP |
| MFI/IV | | 400 | 400 | 400 | 400 | 400 | 400 | 400 | 400 | 400 | 400 |
| Melt Temperature | (C.) | 187 | 188 | 187 | 183 | 188 | 188 | 188 | 188 | 180 | 188 |
| Number of Orifices | | 168 | 168 | 84 | 84 | 168 | 168 | 168 | 84 | 84 | 84 |
| Polymer Flow Rate | (g/orifice/min) | 1.00 | 1.00 | 1.00 | 1.04 | 1.00 | 1.00 | 1.00 | 0.49 | 4.03 | 1.00 |
| Orifice Diameter | (mm) | 0.343 | 0.508 | 0.889 | 1.588 | 0.508 | 0.508 | 0.508 | 0.889 | 0.889 | 0.889 |
| Orifice L/D | | 9.26 | 6.25 | 3.57 | 1.5 | 6.25 | 6.25 | 6.25 | 3.57 | 3.57 | 3.57 |
| Air Knife Gap | (mm) | 0.762 | 0.762 | 0.762 | 0.762 | 0.762 | 0.762 | 0.762 | 0.381 | 1.778 | 0.381 |
| Attenuator Body Angle | (degrees) | 30 | 30 | 30 | 30 | 30 | 30 | 30 | 20 | 40 | 20 |
| Attenuator Air Temperature | (C.) | 25 | 25 | 25 | 25 | 25 | 25 | 25 | 25 | 25 | 25 |
| Quench Air Rate | (ACMM) | 0.44 | 0.35 | 0.38 | 0.38 | 0.38 | 0.37 | 0 | 0.09 | 0.59 | 0.26 |
| Clamping Force | (Newtons) | 221 | 221 | 59.2 | 63.1 | 148 | 237 | 0 | 23.7 | 63.1 | 43.4 |
| Attenuator Air Volume | (ACMM) | 2.94 | 2.07 | 1.78 | 1.21 | 2.59 | 2.15 | 2.57 | 1.06 | >3 | 1.59 |
| Attenuator Gap (Top) | (mm) | 4.19 | 3.28 | 3.81 | 4.24 | 3.61 | 2.03 | 3.51 | 2.03 | 5.33 | 1.98 |
| Attenuator Gap (Bottom) | (mm) | 2.79 | 1.78 | 2.90 | 3.07 | 3.18 | 1.35 | 3.51 | 2.03 | 4.60 | 1.88 |
| Chute Length | (mm) | 152.4 | 152.4 | 152.4 | 152.4 | 76.2 | 228.6 | 25.4 | 152.4 | 152.4 | 152.4 |
| Die to Attenuator Distance | (mm) | 317.5 | 317.5 | 317.5 | 317.5 | 317.5 | 304.8 | 304.8 | 304.8 | 304.8 | 914.4 |
| Attenuator to Collector Dist | (mm) | 609.6 | 609.6 | 609.6 | 609.6 | 609.6 | 609.6 | 609.6 | 609.6 | 609.6 | 304.8 |
| Average Fiber Diameter | (μ) | 10.56 | 9.54 | 15.57 | 14.9 | 13.09 | 10.19 | 11.19 | 9.9 | 22.26 | 14.31 |
| Apparent Filament Speed | (m/min) | 12600 | 15400 | 5770 | 6530 | 8200 | 13500 | 11200 | 6940 | 11400 | 6830 |
| Tenacity | (g/denier) | 2.48 | 4.8 | 1.41 | 1.92 | 2.25 | 2.58 | 2.43 | 2.31 | 0.967 | 1.83 |
| Percent elongation to break | (%) | 180 | 180 | 310 | 230 | 220 | 200 | 140 | 330 | 230 | 220 |
| Draw Area Ratio | | 1050 | 2800 | 3260 | 11400 | 1510 | 2490 | 2060 | 8060 | 1600 | 3860 |
| Melting Point—Middles | (° C.) | 165.4 | 165.0 | 164.1 | 164.1 | 165.2 | 164.0 | 164.3 | 165.2 | 164.3 | 165.4 |
| Second Peak | (° C.) | | | | | | | | | | |
| Melting Point—Ends | (° C.) | 163.9 | 164.0 | 163.4 | 163.4 | 163.2 | 162.5 | 164.0 | 163.3 | 164.3 | 163.2 |
| Second Peak | (° C.) | | | | | | | | | | |
| Crystallinity Index—Middles | | 0.44 | 0.46 | 0.42 | 0.48 | 0.48 | 0.52 | 0.39 | 0.39 | 0.50 | 0.40 |
| Productivity Index | g · m/hole · min$^2$ | 12700 | 15500 | 5770 | 6760 | 8240 | 13600 | 11300 | 3380 | 45800 | 6830 |
| Web Width | (mm) | N/M | 508 | 584 | 292 | 330 | 533 | 102 | 267 | 203 | 241 |
| Fiber stream included angle (γ) | (degrees) | N/M | 37 | 43 | 18 | 21 | 39 | — | 15 | 10 | 26 |

| | | Example Number | | | | | | | | |
|---|---|---|---|---|---|---|---|---|---|---|
| | | 11 | 12 | 13 | 14 | 15 | 16 | 17 | 18 | 19 |
| Polymer | | PP | PP | PP | PP | PP | PP | PP | PP | PP |
| MFI/IV | | 400 | 400 | 400 | 30 | 70 | 70 | 70 | 70 | 70 |
| Melt Temperature | (° C.) | 190 | 196 | 183 | 216 | 201 | 201 | 208 | 207 | 206 |
| Number of Orifices | | 84 | 84 | 84 | 168 | 168 | 168 | 168 | 168 | 168 |
| Polymer Flow Rate | (g/orifice/min) | 1.00 | 1.00 | 1.00 | 0.50 | 1.00 | 0.50 | 0.50 | 0.50 | 0.50 |
| Orifice Diameter | (mm) | 0.889 | 0.889 | 1.588 | 0.508 | 0.343 | 0.343 | 0.343 | 0.343 | 0.343 |
| Orifice L/D | | 3.57 | 3.57 | 1.5 | 3.5 | 9.26 | 3.5 | 3.5 | 3.5 | 3.5 |
| Air Knife Gap | (mm) | 0.381 | 1.778 | 0.762 | 1.270 | 0.762 | 0.762 | 0.762 | 0.762 | 0.762 |

TABLE 1-continued

| | | | | | | | | | | |
|---|---|---|---|---|---|---|---|---|---|---|
| Attenuator Body Angle | (degrees) | 20 | 40 | 30 | 30 | 30 | 30 | 30 | 30 | 30 |
| Attenuator Air Temperature | (° C.) | 25 | 25 | 121 | 25 | 25 | 25 | 25 | 25 | 25 |
| Quench Air Rate | (ACMM) | 0 | 0.59 | 0.34 | 0.19 | 0.17 | 0 | 0.35 | 0.26 | 0.09 |
| Clamping Force | (Newtons) | 27.6 | 15.8 | 55.2 | 25.6 | 221 | 27.6 | 27.6 | 27.6 | 27.6 |
| Attenuator Air Volume | (ACMM) | 0.86 | 1.19 | 1.25 | 1.24 | 2.84 | 0.95 | 0.95 | 1.19 | 1.54 |
| Attenuator Gap (Top) | (mm) | 2.67 | 6.30 | 3.99 | 5.26 | 4.06 | 7.67 | 5.23 | 3.78 | 3.78 |
| Attenuator Gap (Bottom) | (mm) | 2.67 | 6.30 | 2.84 | 4.27 | 2.67 | 7.67 | 5.23 | 3.33 | 3.33 |
| Chute Length | (mm) | 152.4 | 76.2 | 152.4 | 152.4 | 152.4 | 152.4 | 152.4 | 152.4 | 152.4 |
| Die to Attenuator Distance | (mm) | 101.6 | 127 | 317.5 | 1181.1 | 317.5 | 108 | 304.8 | 292.1 | 292.1 |
| Attenuator to Collector Dist. | (mm) | 914.4 | 304.8 | 609.6 | 330.2 | 609.6 | 990.6 | 787.4 | 800.1 | 800.1 |
| Average Fiber Diameter | (μ) | 18.7 | 21.98 | 14.66 | 16.50 | 16.18 | 19.20 | 17.97 | 14.95 | 20.04 |
| Apparent Filament Speed | (m/min) | 4000 | 2900 | 6510 | 2570 | 5370 | 1900 | 2170 | 3350 | 1740 |
| Tenacity | (g/denier) | 0.52 | 0.54 | 1.68 | 2.99 | 2.12 | 2.13 | 2.08 | 2.56 | 0.87 |
| Percent elongation to break | (%) | 150 | 100 | 110 | 240 | 200 | 500 | 450 | 500 | 370 |
| Draw Area Ratio | | 2300 | 1600 | 12000 | 950 | 450 | 320 | 360 | 560 | 290 |
| Melting Point—Middles | (° C.) | 162.3 | 163.9 | 164.5 | 162.7 | 164.8 | 164.4 | 166.2 | 163.9 | 164.1 |
| Second Peak | (° C.) | | | | 167.3 | | | 164.4 | | |
| Melting Point—Ends | (° C.) | 163.1 | 163.4 | 164.3 | 163.5 | 163.8 | 163.7 | 164.0 | 163.9 | 163.9 |
| Second Peak | (° C.) | | | | 166.2 | | | | | |
| Crystallinity Index—Middles | | 0.12 | 0.13 | 0.46 | 0.53 | 0.44 | 0.33 | 0.43 | 0.37 | 0.49 |
| Productivity Index | g · m/hole · $min^2$ | 4000 | 2900 | 6500 | 1280 | 5390 | 950 | 1080 | 1680 | 870 |
| Web Width | (mm) | 292 | 114 | 381 | 254 | 432 | 127 | 165 | 279 | 406 |
| Fiber stream included angle (γ) | (degrees) | 12 | 2.4 | 26 | 26 | 30 | 1.4 | 4.6 | 13 | 22 |

| | | Example Number | | | | | | | |
|---|---|---|---|---|---|---|---|---|---|
| | | 20 | 21 | 22 | 23 | 24 | 25 | 26 | 27 |
| Polymer | | PP | PP | PP | PET | PET | PET | PET | PET |
| MFI/IV | | 70 | 70 | 70 | 0.61 | 0.61 | 0.61 | 0.61 | 0.36 |
| Melt Temperature | (° C.) | 221 | 221 | 221 | 278 | 290 | 281 | 290 | 290 |
| Number of Orifices | | 168 | 168 | 168 | 168 | 168 | 84 | 84 | 168 |
| Polymer Flow Rate | (g/orifice/min) | 0.50 | 0.50 | 0.50 | 1.01 | 1.00 | 0.99 | 0.99 | 1.01 |
| Orifice Diameter | (mm) | 0.343 | 0.343 | 0.343 | 0.343 | 0.508 | 0.889 | 1.588 | 0.508 |
| Orifice L/D | | 3.5 | 3.5 | 3.5 | 3.5 | 3.5 | 3.57 | 3.5 | 3.5 |
| Air Knife Gap | (mm) | 0.762 | 0.762 | 0.762 | 1.778 | 1.270 | 0.762 | 0.381 | 1.270 |
| Attenuator Body Angle | (degrees) | 30 | 30 | 30 | 20 | 30 | 30 | 40 | 30 |
| Attenuator Air Temperature | (° C.) | 25 | 25 | 25 | 25 | 25 | 25 | 25 | 25 |
| Quench Air Rate | (ACMM) | 0.09 | 0.30 | 0.42 | 0.48 | 0.35 | 0.35 | 0.17 | 0.22 |
| Clamping Force | (Newtons) | 27.6 | 150 | 17.0 | 3.9 | 82.8 | 63.1 | 3.9 | 86.8 |
| Attenuator Air Volume | (ACMM) | 1.61 | >3 | 1.61 | 2.11 | 2.02 | 2.59 | 0.64 | 2.40 |
| Attenuator Gap (Top) | (mm) | 3.78 | 3.78 | 3.78 | 4.83 | 5.08 | 5.16 | 2.21 | 5.03 |
| Attenuator Gap (Bottom) | (mm) | 3.33 | 3.35 | 3.35 | 4.83 | 3.66 | 4.01 | 3.00 | 3.86 |
| Chute Length | (mm) | 152.4 | 152.4 | 152.4 | 76.2 | 152.4 | 152.4 | 228.6 | 152.4 |
| Die to Attenuator Distance | (mm) | 508 | 508 | 685.8 | 317.5 | 533.4 | 317.5 | 317.5 | 127 |
| Attenuator to Collector Dist. | (mm) | 584.2 | 584.2 | 431.8 | 609.6 | 762 | 609.6 | 609.6 | 742.95 |
| Average Fiber Diameter | (μ) | 16.58 | 15.73 | 21.77 | 11.86 | 10.59 | 11.92 | 13.26 | 10.05 |
| Apparent Filament Speed | (m/min) | 2550 | 2830 | 1490 | 6770 | 8410 | 6580 | 5320 | 9420 |
| Tenacity | (g/denier) | 1.9 | 1.4 | 1.2 | 3.5 | 5.9 | 3.6 | 3.0 | 3.5 |
| Percent elongation to break | (%) | 210 | 220 | 250 | 40 | 30 | 40 | 50 | 20 |
| Draw Area Ratio | | 430 | 480 | 250 | 840 | 2300 | 5600 | 1400 | 2600 |
| Melting Point—Middles | (° C.) | 165.9 | 163.9 | 165.7 | 260.9 | 259.9 | 265.1 | 261.0 | 256.5 |
| Second Peak | (° C.) | | 167.2 | | 258.5 | 267.2 | — | 258.1 | 268.3 |
| Melting Point—Ends | (° C.) | 164.1 | 164.0 | 163.7 | 257.1 | 257.2 | 255.7 | 257.4 | 257.5 |
| Second Peak | (° C.) | | | | 253.9 | 254.3 | 268.7 | 253.9 | — |
| Crystallinity Index—Middles | | 0.5 | 0.39 | 0.40 | 0.10 | 0.20 | 0.27 | 0.25 | 0.12 |
| Productivity Index | g · m/hole · $min^2$ | 1270 | 1410 | 738 | 6820 | 8400 | 6520 | 5270 | 9500 |
| Web Width | (mm) | 203 | 406 | 279 | N/M | 254 | N/M | 216 | 457 |
| Fiber stream included angle (γ) | (degrees) | 10 | 29 | 23 | N/M | 11 | N/M | 11 | 27 |

| | | Example Number | | | | | | | |
|---|---|---|---|---|---|---|---|---|---|
| | | 28 | 29 | 30 | 31 | 32 | 33 | 34 | 35 |
| Polymer | | PET | PET | PET | PET | PET | Nylon | PS | Urethane |
| MFI/IV | | 0.85 | 0.61 | 0.61 | 0.61 | 0.61 | 130 | 15.5 | 37 |
| Melt Temperature | (° C.) | 290 | 282 | 281 | 281 | 281 | 272 | 268 | 217 |
| Number of Orifices | | 84 | 168 | 168 | 168 | 168 | 84 | 168 | 84 |
| Polymer Flow Rate | (g/orifice/min) | 0.98 | 1.01 | 1.01 | 1.01 | 1.01 | 1.00 | 1.00 | 1.98 |
| Orifice Diameter | (mm) | 1.588 | 0.508 | 0.508 | 0.508 | 0.508 | 0.889 | 0.343 | 0.889 |
| Orifice L/D | | 3.57 | 6.25 | 6.25 | 6.25 | 6.25 | 6.25 | 9.26 | 6.25 |
| Air Knife Gap | (mm) | 0.762 | 0.762 | 0.762 | 0.762 | 0.762 | 0.762 | 0.762 | 0.762 |
| Attenuator Body Angle | (degrees) | 30 | 30 | 30 | 30 | 30 | 30 | 30 | 30 |
| Attenuator Air Temperature | (° C.) | 25 | 25 | 25 | 25 | 25 | 25 | 25 | 25 |
| Quench Air Rate | (ACMM) | 0.19 | 0 | 0.48 | 0.48 | 0.35 | 0.08 | 0.21 | 0 |

TABLE 1-continued

| | | | | | | | | | |
|---|---|---|---|---|---|---|---|---|---|
| Clamping Force | (Newtons) | 39.4 | 82.8 | 86.8 | 82.8 | 82.8 | 39.4 | 71.0 | 86.8 |
| Attenuator Air Volume | (ACMM) | 1.16 | 2.16 | 2.16 | 2.15 | 2.15 | 2.12 | 2.19 | >3 |
| Attenuator Gap (Top) | (mm) | 3.86 | 3.68 | 3.68 | 3.58 | 3.25 | 4.29 | 4.39 | 4.98 |
| Attenuator Gap (Bottom) | (mm) | 3.10 | 3.10 | 3.10 | 3.10 | 2.64 | 3.84 | 3.10 | 4.55 |
| Chute Length | (mm) | 76.2 | 228.6 | 228.6 | 228.6 | 228.6 | 76.2 | 152.4 | 76.2 |
| Die to Attenuator Distance | (mm) | 317.5 | 88.9 | 317.5 | 457.2 | 685.8 | 317.5 | 317.5 | 317.5 |
| Attenuator to Collector Distance | (mm) | 609.6 | 609.6 | 609.6 | 482.6 | 279.4 | 831.85 | 609.6 | 609.6 |
| Average Fiber Diameter | (μ) | 12.64 | 10.15 | 10.59 | 11.93 | 10.7 | 12.94 | 14.35 | 14.77 |
| Apparent Filament Speed | (m/min) | 5800 | 9230 | 8480 | 6690 | 8310 | 6610 | 5940 | 9640 |
| Tenacity | (g/denier) | 3.6 | 3.1 | 4.7 | 4.1 | 5.6 | 3.8 | 1.4 | 3.3 |
| Percent elongation to break | (%) | 30 | 20 | 30 | 40 | 40 | 140 | 40 | 140 |
| Draw Area Ratio | | 16000 | 2500 | 2300 | 1800 | 2300 | 4700 | 570 | 3600 |
| Melting Point—Middles | (° C.) | 268.3 | 265.6 | 265.3 | 262.4 | 261.4 | 221.2 | | 23.7? |
| Second Peak | (° C.) | 257.3 | 257.9 | 269.5 | | * | 218.2 | | ? |
| Melting Point—Ends | (° C.) | 254.1 | 257.2 | 257.2 | 257.4 | 257.4 | 219.8 | | ? |
| Second Peak | (° C.) | 268.9 | 268.4 | * | * | * | — | — | — |
| Crystallinity Index—Middles | | 0.22 | 0.09 | 0.32 | 0.35 | 0.35 | 0.07 | 0 | 0 |
| Productivity Index | g · m/hole · min$^2$ | 5690 | 9320 | 8560 | 6740 | 8380 | 6610 | 5940 | 19100 |
| Web Width | (mm) | 305 | 559 | 559 | 711 | 457 | 279 | 318 | 279 |
| Fiber stream included angle (γ) | (degrees) | 19 | 41 | 41 | 65 | 65 | 12 | 20 | 17 |

| | | Example Number | | | | | | |
|---|---|---|---|---|---|---|---|---|
| | | 36 | 37 | 38 | 39 | 40 | 41 | 42 |
| Polymer | | PE | B1. Copol. | PS/copol. | PE/PSA | PE/PP | Nylon | PP |
| MFI/IV | | 30 | 8 | 15.5/8 | 30/.63 | 30/400 | 130 | 400 |
| Melt Temperature | (° C.) | 200 | 275 | 269 | 205 | 205 | 271 | 206 |
| Number of Orifices | | 168 | 168 | 168 | 168 | 168 | 84 | 84 |
| Polymer Flow Rate | (g/orifice/min) | 0.99 | 0.64 | 1.14 | 0.83 | 0.64 | 0.99 | 2.00 |
| Orifice Diameter | (mm) | 0.508 | 0.508 | 0.508 | 0.508 | 0.508 | 0.889 | 0.889 |
| Orifice L/D | | 6.25 | 6.25 | 6.25 | 6.25 | 6.25 | 6.25 | 6.25 |
| Air Knife Gap | (mm) | 0.762 | 0.762 | 0.762 | 0.762 | 0.762 | 0.762 | 0.762 |
| Attenuator Body Angle | (degrees) | 30 | 30 | 30 | 30 | 30 | 30 | 30 |
| Attenuator Air Temperature | (° C.) | 25 | 25 | 25 | 25 | 25 | 25 | 25 |
| Quench Air Rate | (ACMM) | 0.16 | 0.34 | 0.25 | 0.34 | 0.34 | 0.08 | 0.33 |
| Clamping Force | Newtons | 205 | 0.0 | 27.6 | 23.7 | 213 | 150 | 41.1 |
| Attenuator Air Volume | (ACMM) | 2.62 | 0.41 | 0.92 | 0.54 | 2.39 | >3 | >3 |
| Attenuator Gap (Top) | (mm) | 3.20 | 7.62 | 3.94 | 4.78 | 3.58 | 4.19 | 3.25 |
| Attenuator Gap (Bottom) | (mm) | 2.49 | 7.19 | 3.56 | 4.78 | 3.05 | 3.76 | 2.95 |
| Chute Length | (mm) | 228.6 | 76.2 | 76.2 | 76.2 | 76.2 | 76.2 | 76.2 |
| Die to Attenuator Distance | (mm) | 317.5 | 666.75 | 317.5 | 330.2 | 292.1 | 539.75 | 317.5 |
| Attenuator to Collector Dist | (mm) | 609.6 | 330.2 | 800.1 | 533.4 | 546.1 | 590.55 | 609.6 |
| Average Fiber Diameter | (μ) | 8.17 | 34.37 | 19.35 | 32.34 | 8.97 | 12.8 | 16.57 |
| Apparent Filament Speed | (m/min) | 19800 | 771 | 4700 | 1170 | 11000 | 6700 | 10200 |
| Tenacity | (lb/dtex) | 1.2 | | 1.2 | | 1.1 | 3.5 | 0.8 |
| Percent elongation to break | (%) | 60 | | 30 | | 100 | 50 | 170 |
| Draw Area Ratio | | 3900 | 220 | 690 | 250 | 3200 | 4800 | 2900 |
| Melting Point—Middles | (° C.) | 118.7 | | | | | | 165.1 |
| Second Peak | (° C.) | 123.6 | | | | | | |
| Melting Point—Ends | (° C.) | 122.1 | | | | | | 164.5 |
| Second Peak | (° C.) | | | | | | | |
| Crystallinity Index—Middles | | 0.72 | | 0 | 0 | 0.36 | 0.08 | 0.43 |
| Productivity Index | g · m/hole · min$^2$ | 19535 | 497 | 5340 | 972 | 7040 | 6640 | 20400 |
| Web Width | (mm) | N/M | 89 | 406 | N/M | N/M | 279 | 305 |
| Fiber stream included angle (γ) | (degrees) | N/M | | 22 | 11 | 11 | 17 | 19 |

| | | Example Number | | | | |
|---|---|---|---|---|---|---|
| | | 43 | 44 | 45 | 46 | 47 |
| Polymer | | PP | PET | PETG | PETG | PSA |
| MFI/IV | | 400 | 0.61 | >70 | >70 | 0.63 |
| Melt Temperature | (° C.) | 205 | 290 | 262 | 265 | 200 |
| Number of Orifices | | 84 | ** | 84 | 84 | 84 |
| Polymer Flow Rate | (g/orifice/min) | 2.00 | 0.82 | 1.48 | 1.48 | 0.60 |
| Orifice Diameter | (mm) | 0.889 | 0.38 | 1.588 | 1.588 | 0.508 |
| Orifice L/D | | 6.25 | 6.8 | 3.5 | 3.5 | 3.5 |
| Air Knife Gap | (mm) | 0.762 | 0.762 | 0.762 | 0.762 | 0.762 |
| Attenuator Body Angle | (degrees) | 30 | 30 | 30 | 30 | 30 |
| Attenuator Air Temperature | (° C.) | 25 | 25 | 25 | 25 | 25 |
| Quench Air Rate | (ACMM) | 0.33 | 0 | 0.21 | 0.21 | 0 |
| Clamping Force | (Newtons) | 14.4 | 98.6 | 39.4 | 27.6 | *** |
| Attenuator Air Volume | (ACMM) | 2.20 | 1.5 | 0.84 | 0.99 | 0.56 |
| Attenuator Gap (Top) | (mm) | 4.14 | 4.75 | 3.66 | 3.56 | 6.30 |
| Attenuator Gap (Bottom) | (mm) | 3.61 | 4.45 | 3.38 | 3.40 | 5.31 |
| Chute Length | (mm) | 76.2 | 76.2 | 76.2 | 76.2 | 76.2 |
| Die to Attenuator Distance | (mm) | 317.5 | 102 | 317 | 635 | 330 |
| Attenuator to Collector Distance | (mm) | 609.6 | 838 | 610 | 495 | 572 |

TABLE 1-continued

| | | | | | | |
|---|---|---|---|---|---|---|
| Average Fiber Diameter | (μ) | 13.42 | 8.72 | 19.37 | 21.98 | 38.51 |
| Apparent Filament Speed | (m/min) | 15500 | 10200 | 3860 | 3000 | 545 |
| Tenacity | (g/denier) | 3.6 | 2.1 | 1.64 | 3.19 | — |
| Percent elongation to break | (%) | 130 | 40 | 60 | 80 | — |
| Draw Area Ratio | | 4388 | 1909 | 6716 | 5216 | 1699 |
| Melting Point—Middles | (° C.) | 164.8 | 257.4 | | | |
| Second Peak | (° C.) | | 254.4 | | | |
| Melting Point—Ends | (° C.) | 164.0 | 257.4 | | | |
| Second Peak | (° C.) | | 254.3 | | | |
| Crystallinity Index—Middles | | 0.46 | <0.05 | 0 | 0 | |
| Productivity Index | $g \cdot m/hole \cdot min^2$ | 31100 | 8440 | 5700 | 4420 | 330 |
| Web Width | (mm) | 191 | 381 | 203 | 254 | N/M |
| Fiber stream included angle (γ) | (degrees) | 8 | 19 | 10 | 17 | N/M |

* multiple values
** meltblowing die,
*** walls oscillated at 200 cycles/sec.

What is claimed is:

1. A method for preparing a nonwoven fibrous web comprising a) extruding a stream of filaments from a die having a known width and thickness; b) directing the stream of extruded filaments through a processing chamber that provides attenuation of the extruded filaments, the processing chamber being defined by two narrowly separated walls that are parallel to one another, parallel to said width of the die, and parallel to the longitudinal axis of the stream of extruded filaments; one or both of the walls being movable toward and away from the other wall to establish a desired spacing between the walls; c) intercepting the stream of filaments passed through the processing chamber on a collector where the filaments are collected as a nonwoven fibrous web; and d) selecting a spacing between the walls of the processing chamber that causes the stream of extruded filaments to spread and be collected as a functional web at least 50% greater in width than said width of the die; the processing chamber having a configuration that allows the stated spreading of the web.

2. A method of claim 1 in which the processing chamber defined by the two parallel walls is open to the ambient environment at its longitudinal sides.

3. A method of claim 1 in which the width of the walls in a direction transverse to the direction of filament travel is greater at points downstream of the filament travel than upstream points.

4. A method of claim 3 in which the processing chamber is closed to the ambient environment over at least part of the length of its longitudinal sides.

5. A method of claim 1 in which the parallel walls converge toward one another in the direction of filament travel.

6. A method of claim 1 in which the filaments spread to a width at least two times said width of the die before they reach the collector.

7. A method of claim 1 in which the stream of filaments forms a lofty nonwoven web having a thickness of at least 5 mm and a loft of at least 10 cc/gram.

8. A method of claim 1 in which the solidity of the extruded filaments entering the processing chamber is controlled so that the filaments are autogenously bondable when collected on the collector.

9. A method of claim 1 in which at least one of the walls defining the processing chamber is instantaneously movable toward and away from the other wail and is subject to movement means for providing instantaneous movement during passage of the filaments.

10. A method of claim 1 in which the extruded filaments travel through the processing chamber at an apparent filament speed of at least 8,000 meters per minute.

11. A method of claim 1 in which the extruded filaments travel through the processing chamber at an apparent filament speed of at least 10.000 meters per minute.

12. A method of claim 1 in which the extruded filaments travel through the processing chamber at a velocity sufficient to achieve a productivity index as defined herein of at least 9000.

13. A method for preparing a nonwoven fibrous web comprising a) extruding a stream of filaments from a die having a known width and thickness; b) directing the stream of extruded filaments through a processing chamber that provides primary attenuation of the extruded filaments, the processing chamber being defined by two narrowly separated walls that are parallel to one another, parallel to said width of the die, and parallel to the longitudinal axis of the stream of extruded filaments; one or both of the walls being movable toward and away from the other wall to establish a desired spacing between the walls; c) intercepting the stream of filaments passed through the processing chamber on a collector where the filaments are collected as a nonwoven fibrous web; and d) selecting a spacing between the walls of the processing chamber that causes the stream of extruded filaments to spread to have an included angle in a direction parallel to the width of he die of at least 20°; the processing chamber having a configuration that allows the stated spreading of the web.

14. A method of claim 13 in which the processing chamber defined by the two parallel walls is open to the ambient environment at its longitudinal sides.

15. A method of claim 13 in which the width of the walls in a direction transverse to the direction of filament travel is greater at points downstream of the filament travel than upstream points.

16. A method of claim 1 in which movement of said one or both walls includes a pivoting movement to cause the walls to converge towards one another in the direction of filament travel.

17. A method of claim 13 in which movement of said one or both walls includes a pivoting movement to cause the walls to converge towards one another in the direction of filament travel.

* * * * *

UNITED STATES PATENT AND TRADEMARK OFFICE

CERTIFICATE OF CORRECTION

PATENT NO. : 7,470,389 B2
APPLICATION NO. : 10/934194
DATED : December 30, 2008
INVENTOR(S) : Michael R. Berrigan It is certified that error appears in the above-identified patent and that said Letters Patent is hereby corrected as shown below:

Column 23
Line 24, before “attenuation” insert --primary--
Line 62, delete “wail” and insert --wall--

Column 24
Line 24, delete “10.000” and insert --10,000--
Line 45, delete “he” and insert --the--

Signed and Sealed this

Ninth Day of June, 2009

JOHN DOLL
*Acting Director of the United States Patent and Trademark Office*